US012352492B2

(12) United States Patent
Song

(10) Patent No.: US 12,352,492 B2
(45) Date of Patent: Jul. 8, 2025

(54) HOME APPLIANCE

(71) Applicant: LG Electronics Inc., Seoul (KR)

(72) Inventor: Seongmin Song, Seoul (KR)

(73) Assignee: LG Electronics Inc., Seoul (KR)

( * ) Notice: Subject to any disclaimer, the term of this patent is extended or adjusted under 35 U.S.C. 154(b) by 204 days.

(21) Appl. No.: 18/104,023

(22) Filed: Jan. 31, 2023

(65) Prior Publication Data

US 2023/0243580 A1 Aug. 3, 2023

(30) Foreign Application Priority Data

Jan. 31, 2022 (KR) ..... 10-2022-0013834

(51) Int. Cl.
*F25D 27/00* (2006.01)
*F25D 23/02* (2006.01)

(52) U.S. Cl.
CPC ..... *F25D 27/00* (2013.01); *F25D 23/028* (2013.01); *F25D 2327/001* (2013.01); *F25D 2400/18* (2013.01)

(58) Field of Classification Search
CPC . F25D 2327/001; F25D 27/00; F25D 2400/18
See application file for complete search history.

(56) References Cited

U.S. PATENT DOCUMENTS 8,789,900 B2 7/2014 Laible et al.
9,664,835 B2 5/2017 Kleo et al.
2008/0024047 A1* 1/2008 Juo ..... F25D 23/02 312/236
2010/0270901 A1* 10/2010 Kim ..... F25D 23/02 312/405
2010/0327720 A1* 12/2010 Pae ..... F25D 23/028 49/70
2011/0079034 A1* 4/2011 Kim ..... F25D 23/02 62/449
2011/0089790 A1* 4/2011 Lee ..... F25D 23/02 29/890.035
2021/0199367 A1 7/2021 Kim et al.

FOREIGN PATENT DOCUMENTS

CN 103250018 8/2013
JP 2021-113680 8/2021
WO WO 2021/172948 9/2021

OTHER PUBLICATIONS

Extended European Search Report in European Appln. No. 23154275.4, mailed on May 19, 2023, 7 pages.

* cited by examiner

*Primary Examiner* — David J Teitelbaum
(74) *Attorney, Agent, or Firm* — Fish & Richardson P.C.

(57) ABSTRACT

A home appliance includes: a cabinet defining a storage space, and a door comprising (i) a door body configured to open and close the storage space and (ii) a panel assembly disposed at the door body. The panel assembly includes: a panel defining a front surface of the door and through which light is transmitted, a lighting device disposed at a rear side of the panel and configured to irradiate the light through the panel with a set color, an upper bracket supporting the panel from an upper side of the panel, and a lower bracket supporting the panel from a lower side of the panel. At least one of the upper bracket or the lower bracket includes a bracket protrusion that protrudes to face and cover an upper end or a lower end of the panel to thereby block the light from the lighting device.

20 Claims, 18 Drawing Sheets

HOME APPLIANCE

CROSS-REFERENCE TO RELATED APPLICATIONS

The present application claims priority under 35 U.S.C. 119 and 35 U.S.C. 365 to Korean Patent Application No. 10-2022-0013834, filed on Jan. 31, 2022, which is hereby incorporated by reference in its entirety.

BACKGROUND

The present disclosure relates to a home appliance.

In general, home appliances are disposed in an indoor space and may be disposed to be harmonized with the surrounding space. In addition, to further improve the appearance of the home appliance, a panel defining an outer appearance on a front surface of the home appliance may be provided.

Typically, structures that variously modify the outer appearance of the front surface of the refrigerator so as to be harmonized with environments in which the refrigerator is placed, surrounding furniture, or other home appliances are being developed, and this trend is being made throughout the home appliances.

U.S. Pat. No. 8,789,900 discloses a structure in which a decoration panel defining an outer appearance is installed on a door front of a refrigerator, and here, the outer appearance of the door front is defined according to a user's preference by detachably configuring the decoration panel.

However, the refrigerator having this structure has a problem in that, when a user wants to change the outer appearance, the entire decoration panel needs to be removed and replaced, and it is not possible to use the decoration panel before replacement any longer.

To solve this limitation, Chinese Patent Application No. 103250018 discloses a refrigerator in which a reflective layer and a transparent panel are disposed on a door front and colored light emitting members are mounted on both side ends of the reflective layer to cause the transparent panel to shine with set color.

SUMMARY

Embodiments provide a home appliance in which light is prevented from leaking through a circumference of a panel assembly to improve quality of an outer appearance.

Embodiments also provide a home appliance in which light is provided from leaking through an exposed portion of a side surface of a panel assembly to improve quality of an outer appearance.

In one embodiment, a home appliance includes: a cabinet having a storage space; and a door including a door body configured to open and close the storage space and a panel assembly mounted on the door body, wherein the panel assembly includes: a panel which is configured to define a front surface of the door and through which light is transmitted; a lighting device provided behind the panel so that the panel shines with a set color; an upper bracket configured to support the panel from above; and a lower bracket configured to support the panel from below, wherein a bracket protrusion that is in contact with an upper end or a lower end of the panel is disposed on the upper bracket or the lower bracket, and the bracket protrusion protrudes to cover the upper end or the lower end of the panel so as to prevent the light from leaking from the lighting device.

The bracket protrusion may be configured to cover a rear portion of the panel with respect to a center in a front and rear direction of the panel.

The bracket protrusion may include: a support portion configured to support the upper end and the lower end of the panel; and a blocking portion protruding more than the support portion at a rear side of the support portion to block a portion of a rear surface of the panel.

The blocking portion may protrude toward a central portion of the panel via the upper end or the lower end of the panel.

The bracket protrusion may be disposed on both the upper bracket and the lower bracket.

A top surface of the panel may have a rounded shape of which a central portion in a front and rear direction protrudes most.

The support portion may be configured so that the upper end of the panel is in contact with the upper bracket, and the blocking portion may have a rounded shape to correspond to the top surface of the panel.

The blocking portion may extend downward from a rear side of the support portion.

The blocking portion may be disposed between an upper end and a lower end of the rounded shape of the top surface of the panel.

A bottom surface of the panel may have a planar shape perpendicular to a front surface of a bottom surface of the panel, and an inclined surface may be disposed on each of a front end and a rear end of the bottom surface of the panel.

The support portion may be disposed on the lower bracket to support the bottom surface of the panel, and the blocking portion may protrude from a rear side of the support portion to support the inclined surface.

A top surface of the blocking portion may be disposed to have an inclination corresponding to the inclined surface so as to be in surface contact with the inclined surface.

An upper end of the blocking portion may extend to be disposed between the bottom surface of the panel and an upper end of the inclined surface.

The door may further include a light guide plate disposed behind the panel to guide light irradiated from the lighting device toward the panel, and an upper end and a lower end of the light guide plate may be disposed behind the blocking portion to protrude more than the upper end and the lower end of the panel.

The door may further include a mounting member provided between the panel and the light guide plate and made of a material through which light is transmitted, wherein the mounting member may include: a front surface portion to which the panel is attached; and a side surface portion extending backward from each of both ends of the front surface portion to define both side surfaces of the panel assembly, wherein both ends of the light guide plate may be mounted on the side surface portions, respectively.

An upper end and a lower end of the front surface portion may protrude more than an upper end and lower end of each of the light guide plate and the blocking portion.

The side surface portion may be opaquely provided by any one of printing, deposition, and coating.

A side blocking portion made of a material, which blocks light, to cover the side surface portion may be provided on the side surface portion.

A side blocking portion made of a material, which blocks light, to prevent the light of the light guide plate from being emitted laterally may be attached to each of both left and right surfaces of the light guide plate.

The lighting device may be provided inside the lower bracket, and a light source of the lighting device may be disposed lower than the support portion and the light blocking portion.

The details of one or more embodiments are set forth in the accompanying drawings and the description below. Other features will be apparent from the description and drawings, and from the claims.

BRIEF DESCRIPTION OF THE DRAWINGS

FIG. 14 is a front view illustrating an outer appearance of the front surface of the refrigerator that is in a state in which the lighting device is turned on.

DETAILED DESCRIPTION OF THE EMBODIMENTS

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Prior to a description, directions are defined. In an embodiment of the present disclosure, a direction toward a door is defined as a front direction with respect to a cabinet shown in FIGS. 2 and 2, a direction toward the cabinet with respect to the door is defined as a rear direction, a direction toward a bottom on which a refrigerator is installed is defined as a downward direction, and a direction away from the bottom is defined as an upward direction.

Figure 1:
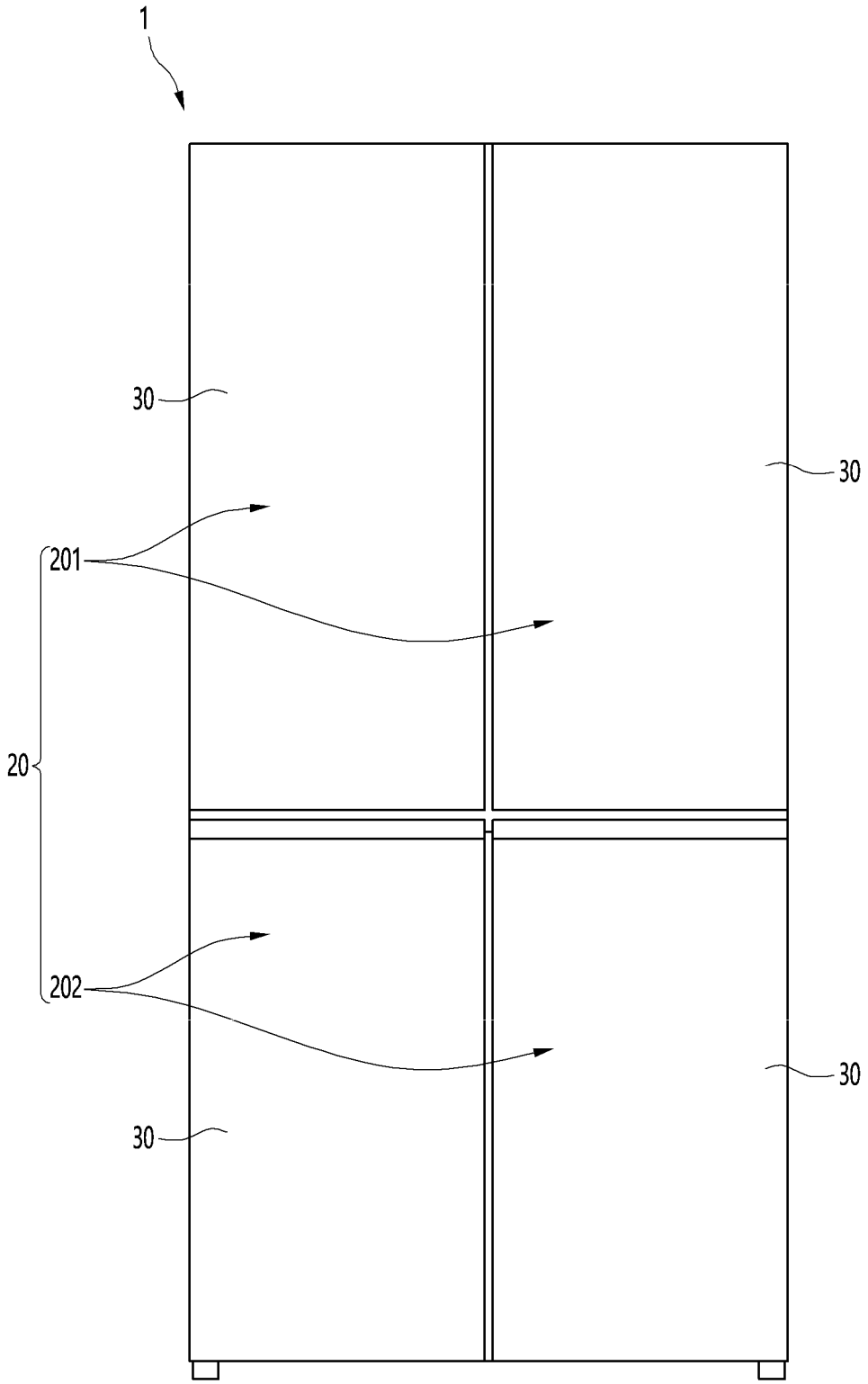
FIG. 1 is a front view of a refrigerator according to a first embodiment.
Figure 2:
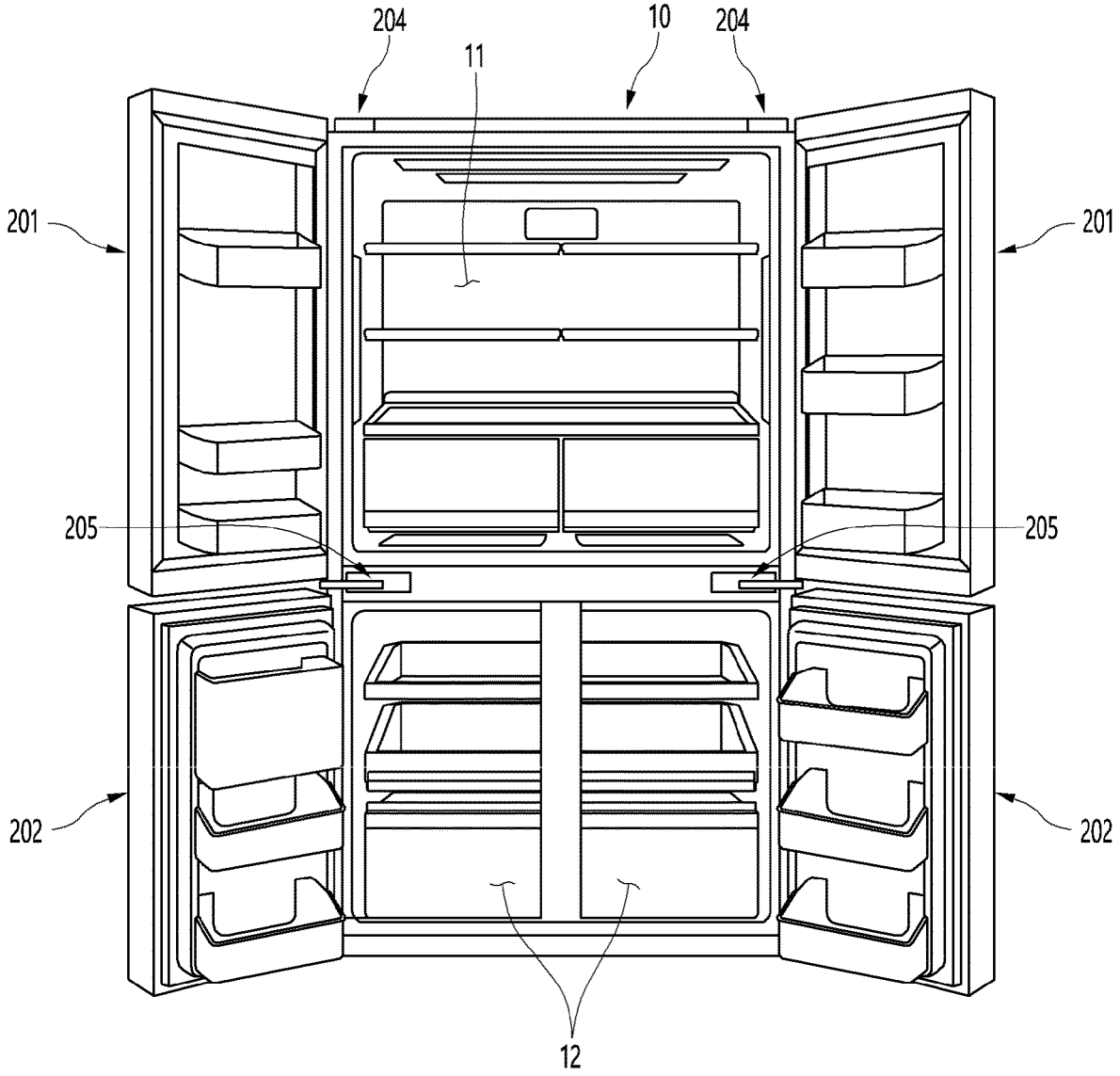
FIG. 2 is a front view illustrating a state in which a door of the refrigerator is opened.

FIG. 1 is a front view of a refrigerator according to a first embodiment. Also, FIG. 2 is a front view illustrating a state in which a door of the refrigerator is opened.

As illustrated in the drawings, an outer appearance of a refrigerator 1 according to an embodiment may be defined by a cabinet 10 in which a storage space is defined, and a door 20 for opening and closing the storage space of the cabinet 10.

For example, the cabinet 10 may define the storage space partitioned in a vertical direction. Here, a refrigerating compartment 11 may be defined at an upper portion of the cabinet 10, and a freezing compartment 12 may be defined at a lower portion of the cabinet 10. The refrigerating compartment 11 may be referred to as an upper storage space, and the freezing compartment 12 may be referred to as a lower storage space.

The door 20 may be configured to open and close each of the refrigerating compartment 11 and the freezing compartment 12. For example, the door 20 may be connected to the cabinet by hinge devices 204 and 205 and then rotatably mounted to the cabinet 10, and each of the refrigerating compartment 11 and the freezing compartment 12 may be opened and closed by the rotation.

The door 20 may include a refrigerating compartment door 201 that opens and closes the refrigerating compartment 11 and a freezing compartment door 202 that opens and closes the freezing compartment 12. In addition, the refrigerating compartment door 201 may be disposed in a pair side by side at both left and right sides, and each of the refrigerating compartment doors 201 may partially open and close the refrigerating compartment 11. In addition, the freezing compartment door 202 may be disposed in a pair side by side at both left and right sides, and each of the freezing compartments 12 partitioned to the left and right sides may be opened and closed.

Of course, although the refrigerator having a structure in which a refrigerating compartment 11 is disposed at an upper side, and a freezing compartment 12 is disposed at a lower side is described as an example in the embodiment, the present disclosure may be applied to all types of refrigerators equipped with a door without being limited to types of refrigerators.

An outer appearance of the front surface of the refrigerator 1 may be defined in the state in which the door 20 is closed and may define the out appearance of the refrigerator 1 viewed from the front in the state in which the refrigerator 1 is installed.

The door 20 may have a structure in which a front surface selectively emits light and may be configured to shine with set color or brightness. Thus, a user may manipulate the refrigerator 1 so that the front surface of the refrigerator 1 is changed in color or brightness of the door 20 without separating or disassembling the door 20 and may change the overall outer appearance of the refrigerator 1.

Hereinafter, the structure of the door 20 will be described in detail with reference to drawings. In addition, in an embodiment of the present disclosure will be described with reference to the refrigerator compartment door 201 disposed at the left side, and other doors may have the same structure with only a difference in mounting position.

Figure 3:
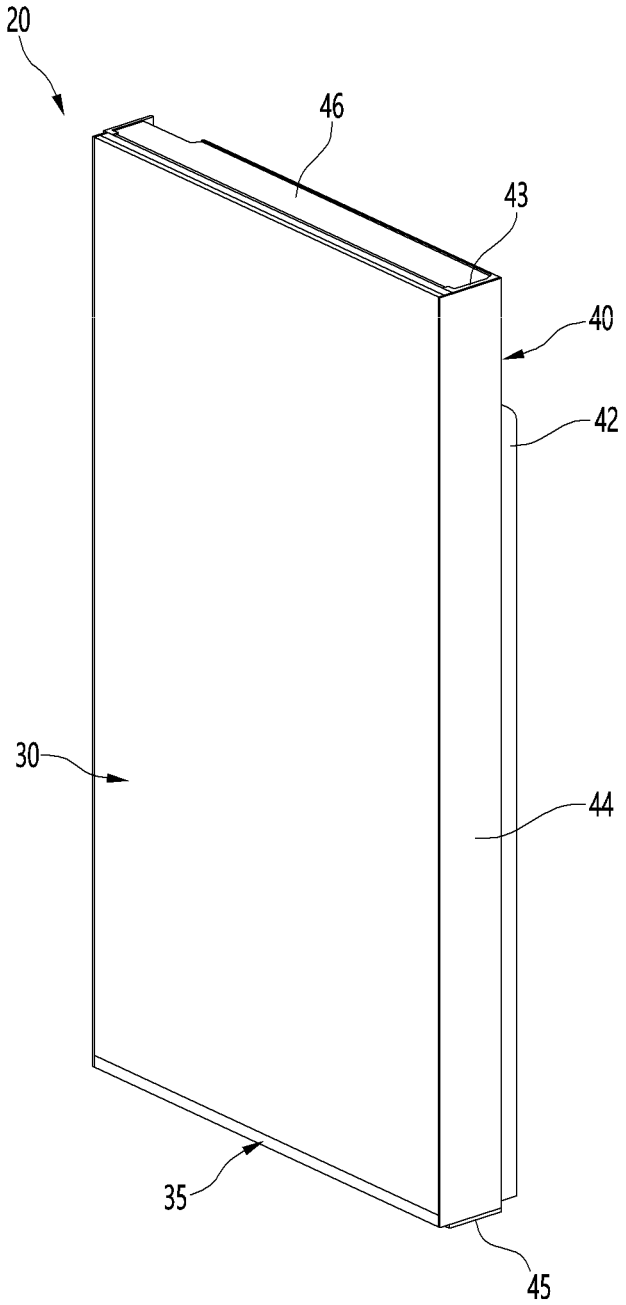
FIG. 3 is a perspective view of the door.
Figure 4:
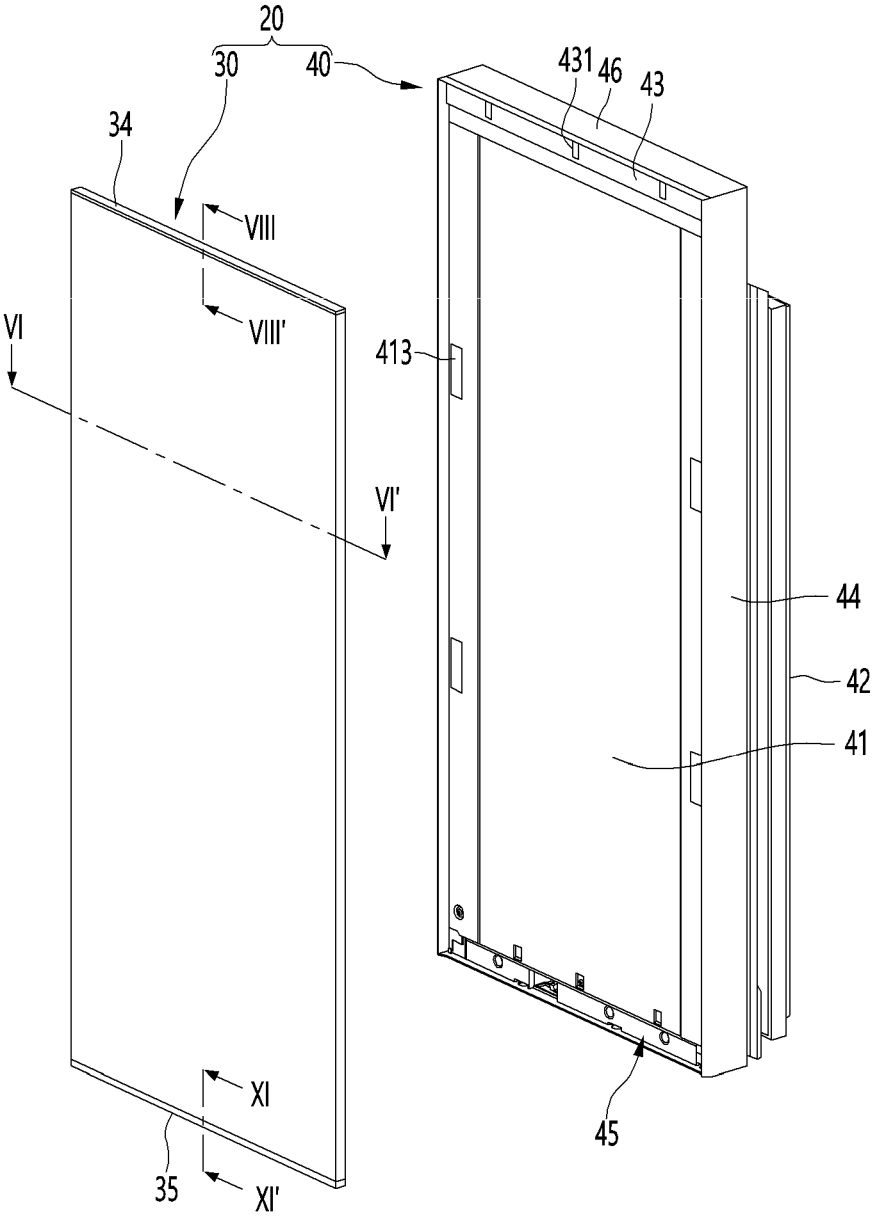
FIG. 4 is an exploded perspective view illustrating a state in which a panel assembly and a door body, which are components of the door, are separated from each other.

FIG. 3 is a perspective view of the door. Also, FIG. 4 is an exploded perspective view illustrating a state in which a panel assembly and a door body, which are components of the door, are separated from each other.

As illustrated in the drawings, the door 20 may include a door body 21 defining the overall shape of the door 20 and configured to open and close the storage space and a panel assembly 30 defining an outer appearance of a front surface of the door 20. That is, the door 20 may be configured so that the panel assembly 30 is mounted on a front surface of the door body 40.

The door body 40 may include a body plate 41 defining a front surface and a door liner 42 defining a rear surface. The body plate 41 may be made of a metal material and disposed to face a rear surface of the panel assembly 30. The door liner 42 may be made of a plastic material and may form a bottom shape of the door 20.

The door body 40 may include a side decoration 44 defining right and left side surfaces of the door body 21. The side decoration 44 may connect both right and left ends of the body plate 41 and both right and left ends of the door liner 42.

The door body 40 may include an upper cap decoration 43 and a lower cap decoration 45 that form top and bottom surfaces of the door body 40. The upper cap decoration 43 may be connected to an upper end of the side decoration 44, an upper end of the body plate 41, and an upper end of the door liner 42. The lower cap decoration 45 may be connected to a lower end of the side decoration 44, a lower end of the body plate 41, and a lower end of the door liner 42.

In addition, an insulator 400 may be filled in an internal space of the door body 40, which is defined by coupling the body plate 41, the door liner 42, the side decoration 44, the upper cap decoration 43, and the lower cap decoration 45.

The panel assembly 30 may be provided in a plate shape and may define an outer appearance of the front surface of the door 20 while being mounted on the front surface of the door body 40. The panel assembly 30 may have a size corresponding to that of the front surface of the door body 40. Therefore, in a state in which the panel assembly 30 is mounted, an outer appearance of the front surface of the door 20 may be defined by the panel assembly 30. In addition, at least a portion of the circumference of the panel assembly 30 may protrude further forward than the door body 40 and may define a circumference of the outer appearance of the door 20.

The panel assembly 30 may be detachably mounted on the door body 40.

For example, the lower end of the panel assembly 30 may be supported by the lower cap decoration 45, and an upper protrusion 343 may be disposed on an upper end of the rear surface of the panel assembly 30 and be inserted and mounted into an upper mounting portion 431 on the front surface of the door body 40. In addition, the upper protrusion 343 may be restricted by an upper cover 46 mounted on an opened top surface of the upper cap decoration 43.

As described above, the panel assembly 30 may be detachably mounted from the door body 40 for services and maintenance.

A front surface of the panel assembly 30 may be exposed forward in the state in which the panel assembly 30 is mounted on the door body 40, and the panel assembly 30 may substantially form the outer appearance of the front surface of the door 20. That is, a color of the outer appearance of the front surface of the door 20 may be determined by a color of the front surface of the panel assembly 30. In addition, the entire front surface of the panel assembly 30 may be configured to shine in a color specified by the user, and in the state in which the door 20 and the panel assembly 30 are mounted, various colors selected by the user may be changed to variously express the color of the front surface of the door 20.

Hereinafter, the structure of the panel assembly 30 will be described in more detail with reference to drawings.

Figure 5:
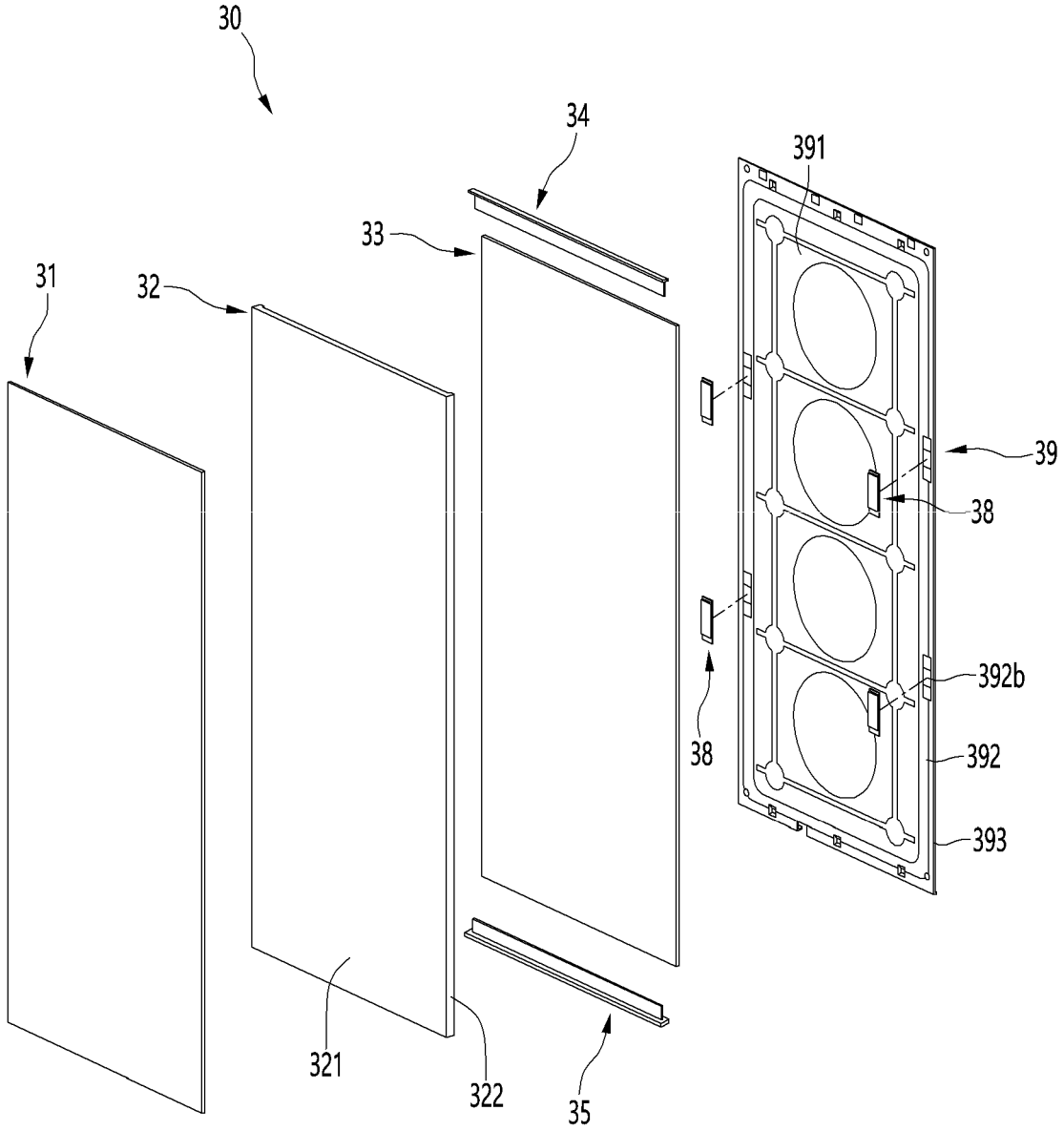
FIG. 5 is an exploded front perspective view of the panel assembly.
Figure 6:
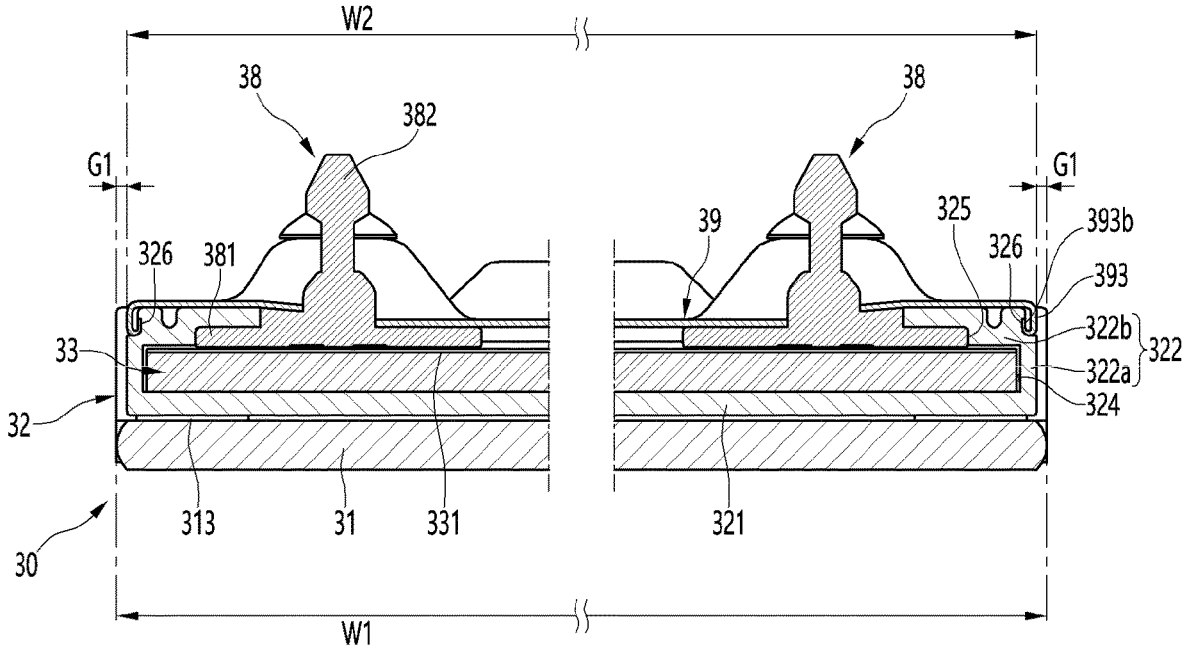
FIG. 6 is a cross-sectional view taken along line VI-VI' of FIG. 4.

FIG. 5 is an exploded front perspective view of the panel assembly. FIG. 6 is a cross-sectional view taken along line VI-VI' of FIG. 4.

As illustrated in the drawings, the panel assembly 30 may include a panel 31 defining an outer appearance of the front surface, a lighting device 36 irradiating light to allow the panel 31 to shine, a light guide plate 33 guiding light irradiated from the lighting device 36, and a mounting member 32 on which the panel 31 is mounted.

The panel assembly 30 may include an upper bracket 34 forming a top surface of the panel assembly 30 and a lower bracket 35 forming a bottom surface of the panel assembly 30. In addition, the lighting device 36 may be mounted on the lower bracket 35.

In addition, the panel assembly 30 may further include a back cover 39 defining an outer appearance of a rear surface of the panel assembly 30.

In more detail, the panel 31 may be provided in a rectangular plate shape and may be made of a transparent material that transmits light therethrough. For example the panel 31 may be made of a glass material such as blue glass, white glass, and vapor deposition glass or may be made of other materials for transmitting light therethrough, such as ABS, PMMA, or PC. In all embodiments of the present disclosure, the terms "transparent" and "transmission" may be defined as a state in which the light passes to display a set color through the panel 31.

In addition, the panel 31 may be provided to have a color. The front plate 31 may be configured to transmit light emitted from the lighting device 36 but components behind the front plate 31 may not be seen therethrough.

In addition, the panel 31 may be mounted on a front surface of the mounting member 32. In the state in which the panel 31 is attached to the mounting member 32, when viewed from the front, the components 31 disposed behind the panel in addition to the mounting member 32 may not be exposed to the outside, and the outer appearance of the front surfaces of the panel assembly 30 and the door 20 may be defined.

The light guide plate 33 may be positioned at a rear spaced apart from the panel 31 and may be configured to guide light emitted from the lighting device 36 disposed below the light guide plate 33 forward toward the panel 31. A reflective layer 331 may be disposed on a rear surface of the light guide plate 33 so that light inside the light guide plate 33 is directed forward.

The mounting member 32 may be disposed between the panel 31 and the light guide plate 33. The mounting member 32 may be configured so that the light guide plate 33 and the panel 31 are fixedly mounted thereon. The mounting member 32 may be made of a material that allows light to be transmitted.

The mounting member 32 may include a front surface portion 321 having a plate shape, and a side surface portion 322 that protrudes backward from each of both right and left ends of the front surface portion 321. The front surface portion 321 may be disposed between the panel 31 and the light guide plate 33, and also, the front surface may be in contact with the panel 31, and the rear surface may be in contact with the light guide plate 33. In addition, the side surface portion 322 may provide a structure on which the light guide plate 33 is fixed, and the upper bracket 34, the lower bracket 35, and the back cover 39 are mounted.

In detail, the front surface portion 321 may be provided in the plate shape having a size corresponding to that of the panel 31, and an adhesive member 313 may be applied around the front surface portion 321 so that the panel 31 adheres to the mounting member 32.

In addition, a horizontal width W2 of the front surface portion 321 may be slightly less than a horizontal width W1 of the panel 31. That is, in a state in which the panel 31 is mounted on the front surface portion 321, a side end of the panel 31 may protrude further than a side end of the front surface portion 321 by a predetermined distance G1.

Thus, when the panel assembly 30 is viewed from the front side, the width W1 of the panel 31 may be greater than the width W2 of the mounting member 32, and thus, the mounting member 32 may not be exposed forward.

Particularly, the side surface portions 322 disposed at both left and right ends of the front portion 321 are disposed more inside than both the ends of the panel 31. Thus, the side surface portion 322 may be exposed laterally to define the outer appearance of the door 20, but may be obscured by the panel 31 when viewed from the front side. Thus, even if light is irradiated through the mounting member 32, the side surface portion 322 is not seen forward.

The side surface portions 322 may be disposed along both left and right ends of the light guide plate 33 to restrict both the ends of the light guide plate 33. In addition, the upper bracket 34, the lower bracket 35, and the back cover 39 may also be mounted on the side surface portion 322.

In detail, the side surface portion 322 may include a first part 322*a* extending backward from each of both left and right ends of the front surface portion 321 and a second part 323 bent from an end of the first part 322*a*.

The first part 322*a* may extend perpendicular to the front surface portion 321 from each of both the left and right ends of the front surface portion 321 and may define a side surface of the panel assembly 30.

In addition, a restriction groove 326 may be defined in the first part 322*a*. The restriction groove 326 may be defined so that the side restriction portion 393*a* of the back cover 39 is inserted when the back cover 39 is mounted.

The second part 322*b* may extend perpendicular to the first part 322*a*. The second part 322*b* may be configured to restrict the light guide plate 33 and simultaneously restrict both the ends of the upper bracket 34 and the lower bracket 35.

In detail, the front surface of the second part 322*b* may be defined to have a stepped shape. Thus, a light guide plate insertion space 324 and a bracket insertion space 325 may be defined in the side surface portion 322 by the first part 322*a*, the second part 322*b*, and the front surface part 321, respectively.

In a state in which the light guide plate 33 is inserted into the light guide plate insertion space 324, both left and right ends of the light guide plate 33 may be restricted, and movement of the light guide plate 33 in the front and rear direction may be restricted. In addition, the lower end of the light guide plate 33 may be disposed to face the lighting device 36.

The upper bracket 34 and the lower bracket 35 may be inserted into the bracket insertion space 325 so as to be firmly coupled to the mounting member 32. In addition, the upper bracket 34 and the lower bracket 35 may define top and bottom surfaces of the panel assembly 30 in the state of being coupled to the mounting member 32 and may be coupled to the back cover 39.

In addition, the mounting bracket 38 may be inserted into the bracket insertion space 325. The mounting bracket 38 may allow the panel assembly 30 to be fixedly mounted to the door body 40 and may pass through a bracket opening 392*b* of the back cover 39 in the state of being mounted on the side surface portion 322. The mounting bracket 38 may be provided between the upper bracket 34 and the lower bracket 35 and may be provided in plurality along the side surface portions 322 on both the sides thereof.

In detail, the mounting bracket 38 may include a fixing portion 381 fixed to the side surface portion 322 and a protrusion 382 passing through the back cover 39 so as to be restricted on the front surface of the door body 40. The fixing portion 381 may be provided in a plate shape that is in close contact with the rear surface of the light guide plate 33, and at least a portion of the fixing portion 381 may be inserted and fixed inside the bracket insertion space 325. In addition, the protrusion 382 may extend backward from the fixing portion 381 to pass through the bracket opening 392*b*. In addition, an end of the protrusion 382 may be provided in a hook shape to be hooked in the state of being inserted into the bracket opening 392*b*. Thus, the panel assembly 30 may provide an additional fixing structure to the door body 40 by the mounting bracket 38.

The back cover may be coupled to the upper bracket and the lower bracket, and the assembly structure of the panel assembly may be completed by the coupling of the back cover.

The back cover 39 may be provided in the form of a plate made of a metal material and may define the rear surface of the panel assembly 30. The back cover 39 may include a cover protrusion 391 at the center of the back cover 39 and a cover circumferential portion 392 disposed along a circumference of the cover protrusion 391, and the cover protrusion 391 and the cover circumferential portion 392 may be provided through forming.

The cover protrusion 391 may be disposed inside the cover circumferential portion 392, that is, at the center of the back cover 39 and may protrude more forward than the cover circumferential portion 392. In addition, when the back cover 39 is mounted, the rear surface of the light guide plate 33 may be supported by the cover protrusion 391.

The cover circumferential portion 392 may define the circumference of the back cover 39 and may be disposed along the circumference of the cover protrusion 392. In addition, the bracket opening 392*b* through which the mounting bracket 38 passes may be defined at each of both left and right sides of the cover circumferential portion 392.

In addition, a cover side surface 393 bent forward may be disposed at each of both left and right ends of the cover circumferential portion 392. In addition, the side restriction portion 393*a* inserted into the restriction groove 326 may be disposed on an end of the cover side surface 393. Thus, both the left and right ends of the back cover may be coupled to the side surface portions of the mounting member, respectively.

In addition, a screw 397*a* may be coupled to each of the upper and lower ends of back cover 39, and then, the upper and lower ends of the back cover may be coupled to the upper bracket 34 and the lower bracket 35, respectively. The coupling structure of the back cover 39 and the upper and lower brackets 34 and 35 will be described in more detail below.

Figure 7:
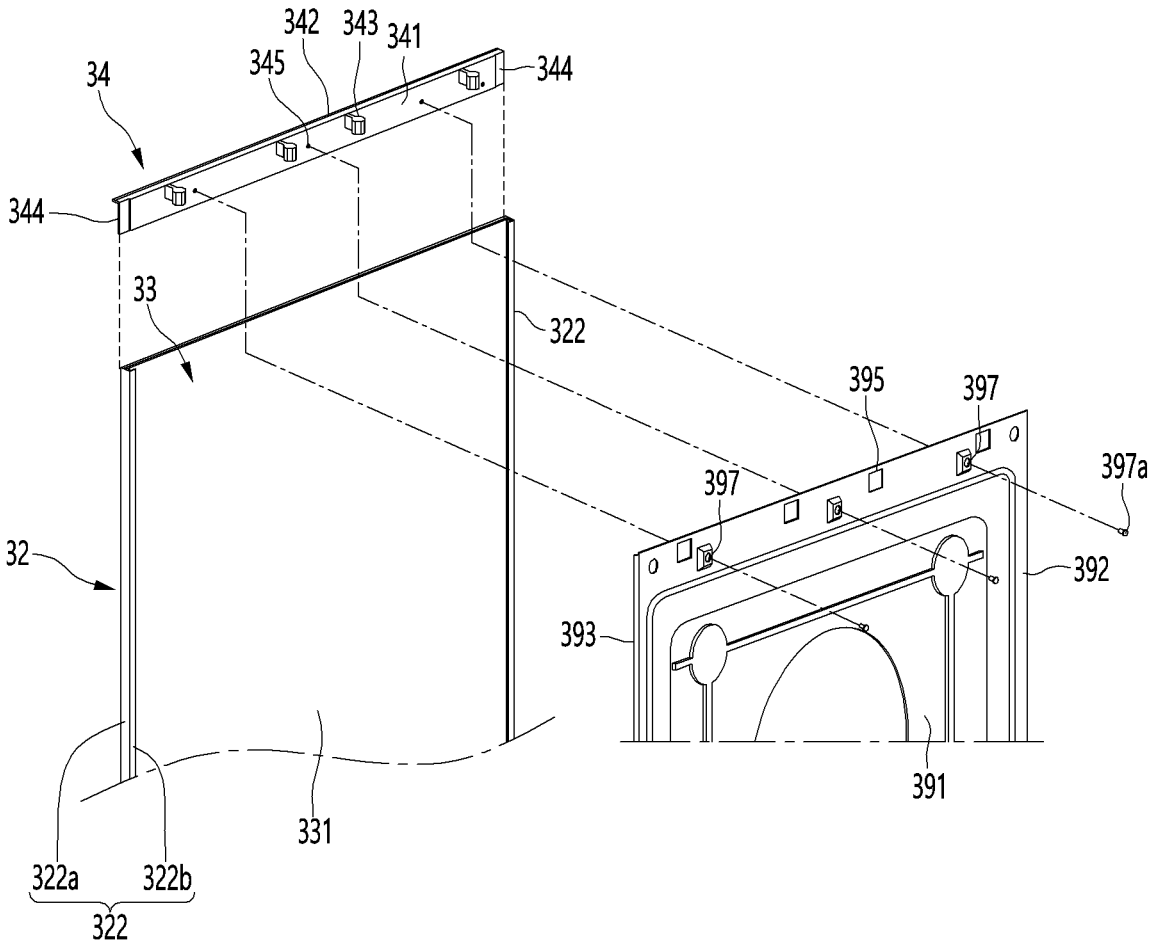
FIG. 7 is an exploded perspective view illustrating a coupling structure of the mounting member, the upper bracket, and the back cover, which constitute the panel assembly.
Figure 8:
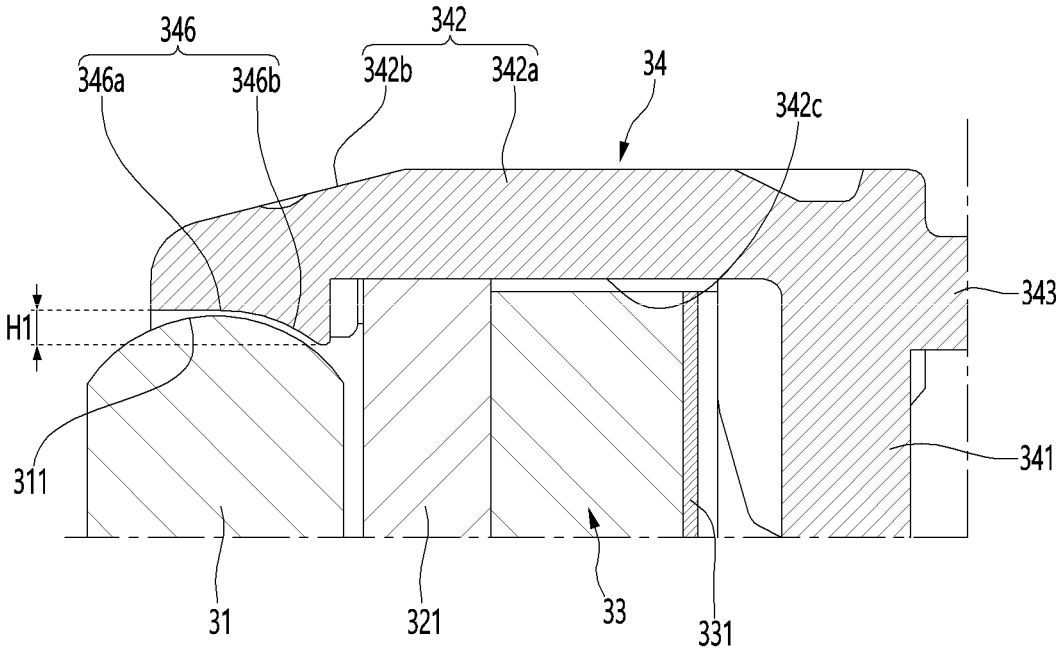
FIG. 8 is a cross-sectional view taken along line VIII-VIII' of FIG. 4.

FIG. 7 is an exploded perspective view illustrating a coupling structure of the mounting member, the upper bracket, and the back cover, which constitute the panel assembly. Also, FIG. 8 is a cross-sectional view taken along line VIII-VIII' of FIG. 4.

As illustrated in the drawings, the upper bracket 34 may include an upper bracket extension portion 341 and an upper bracket top surface portion 342. The upper bracket extension portion 341 may be configured to the upper bracket 34 may be disposed in parallel with the panel 31 and the light guide plate 33 to extend in the vertical direction.

In addition, an upper bracket mounting portion 344 may be disposed on each of both left and right ends of the upper bracket extension portion 341. The upper bracket mounting portion 344 may be inserted by being slid downward from an upper side of the bracket insertion space 325.

In the state in which the upper bracket 34 is mounted on the mounting member 32, the upper bracket mounting portion 344 may be fixed in the bracket insertion space 325, and the remaining upper bracket extension portion 341 may be exposed between both the side surface portions 322 to support the upper end of the back cover 39 and to be coupled to the upper end of the back cover 39.

An upper protrusion 343 protruding backward may be disposed on a rear surface of the upper bracket extension portion 341. The upper protrusion 343 may protrude from the upper bracket extension portion and be coupled to the upper mounting portion 431 of the upper cap decoration 43.

The upper protrusions 343 may be provided at regular intervals along the upper bracket 34. In addition, the upper protrusion 343 may protrude to pass through the protrusion opening 395 of the back cover 39 when the back cover 39 is mounted.

An upper bracket screw hole 345 to be coupled to the screw 397*a* may be defined in the upper bracket extension portion 341. When the back cover 39 is mounted, the screw 397*a* may be coupled to sequentially pass through a cover screw hole 397 defined in the back cover 39 and an upper bracket screw hole 345. Thus, the upper bracket 34 and the back cover 39 may be coupled to each other, and the mounting member 32 and the light guide plate 33 inside the mounting member 32 may also be fixed.

The upper bracket top surface portion 342 may be disposed on an upper end of the upper bracket extension portion 341. The upper bracket top surface portion 342 may include a first top surface portion 342*a* and a second top surface portion 342*b*.

The first top surface portion 342*a* may extend forward from an upper end of the extension portion 341 and define a portion of the top surface of the panel assembly 30. In addition, the first top surface portion 342*a* may be provided perpendicular to the extension portion 341 and may extend further forward than the front surface of the mounting member 32. Thus, the upper ends of the mounting member 32 and the light guide plate 33 may be shielded by the first top surface portion 342*a* in the state in which the upper bracket 34 is mounted.

The second top surface portion 342*b* may further extend forward from a front end of the first top surface portion 342*a* and may define a front end of the top surface of the panel assembly 30. The front end of the second top surface portion 342*b* may overlap at least a portion of the top surface of the panel 31. Thus, the front end of the upper bracket top surface portion 342 may support the upper end of the panel 31.

In addition, the second top surface portion 342*b* may be provided to be gradually lowered downward as the second top surface portion 342*b* extends forward. A top surface of the second top surface portion 342*b* may be provided to be inclined or rounded, and thus, the second top surface portion 342*b* may be referred to as an inclined portion or a rounded portion. A front end of the second top surface portion 342*b* may be disposed at the rear side rather than the front side of the panel 31, and a height thereof may also be the lowest level. Thus, the second top surface portion 342*b* may be prevented from being exposed to the outside of the panel 31 when viewed from the front side.

A bracket protrusion 346 extending downward may be disposed on the front end of the upper bracket top surface portion 342, that is, on the lower end of the second top surface portion 342*b*. The bracket protrusion 346 may support the upper end of the panel 31 and may prevent light irradiated from the rear side from leaking between the upper end of the panel 31 and the upper bracket 34.

In detail, as illustrated in FIG. 8, the top surface 311 of the panel 31 may be provided in a round shape having a predetermined curvature. In addition, the top surface 311 of the panel 31 may be referred to as an upper round portion. The top surface 311 of the panel 31 may have a round which has the most protruding center and front and rear surfaces that are gradually lowered. An impact or load applied to the upper end of the panel 31 may be dispersed through the top surface 311 of the panel 30 having a curved shape, and thus the panel 31 may be prevented from being damaged.

In addition, the bracket protrusion 346 may protrude downward from the front end of the upper bracket top surface 342. The bracket protrusion 346 may extend further downward than the upper end of the mounting member 32 and the upper end of the light guide plate 33. Thus, the upper ends of the mounting member 32 and the light guide plate 33 may be prevented from being exposed. In addition, the bracket protrusion 346 may extend downward to support the upper end of the panel 31.

The bracket protrusion 346 may include an upper support portion 346*a* and an upper blocking portion 346*b*. The upper support portion 346*a* may extend backward from the front end of the upper bracket top surface portion 342. In addition, the upper support portion 346*a* may extend to be in contact with the most protruding portion of the top surface 311 of the panel 31. Here, the upper support portion 346*a* may be provided in a planar shape and may define a surface crossing the front surface of the panel 31.

The upper blocking portion 346*b* may extend backward and downward from the rear end of the upper support portion 346*a*. The upper blocking portion 346*b* may protrude downward as the upper blocking portion 346*b* extends rearward and may have a curvature or inclination corresponding to the top surface 311 of the panel 31.

Here, the upper blocking portion 346*b* may be disposed at a height lower than the upper ends of the mounting member 32 and the light guide plate 33 and extend further downward than a bottom surface of the upper support portion 346*a* by a set height H1. In addition, the upper blocking portion 346*b* may extend further downward than the upper end of the panel 31 on the basis on the panel 31.

Accordingly, the upper blocking portion 346*b* may block the light irradiated from the rear side from passing between the upper end of the panel 31 and the upper support portion 346*a*. In addition, when the panel assembly 30 is viewed in the state in which the lighting device 36 is turned on, the light may be prevented from leaking between the upper end of the panel 31 and the upper bracket 34.

Figure 9:
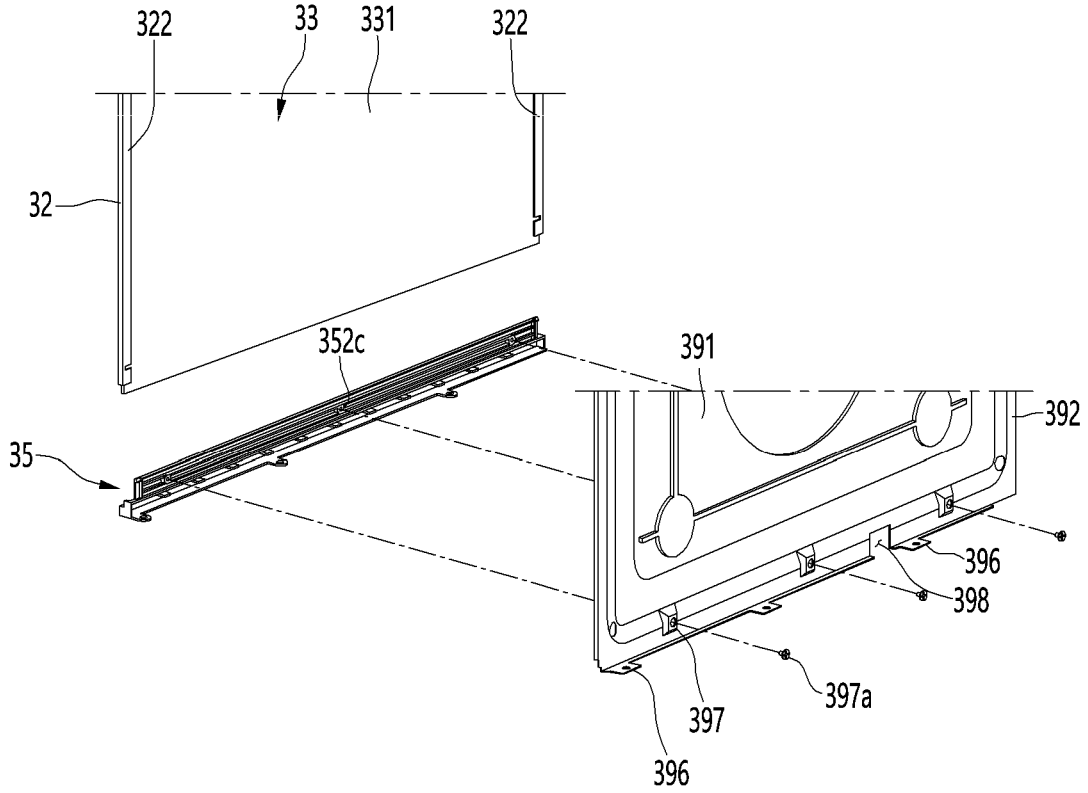
FIG. 9 is an exploded perspective view illustrating a coupling structure of the mounting member, the lower bracket, and the back cover, which constitute the panel assembly.
Figure 10:
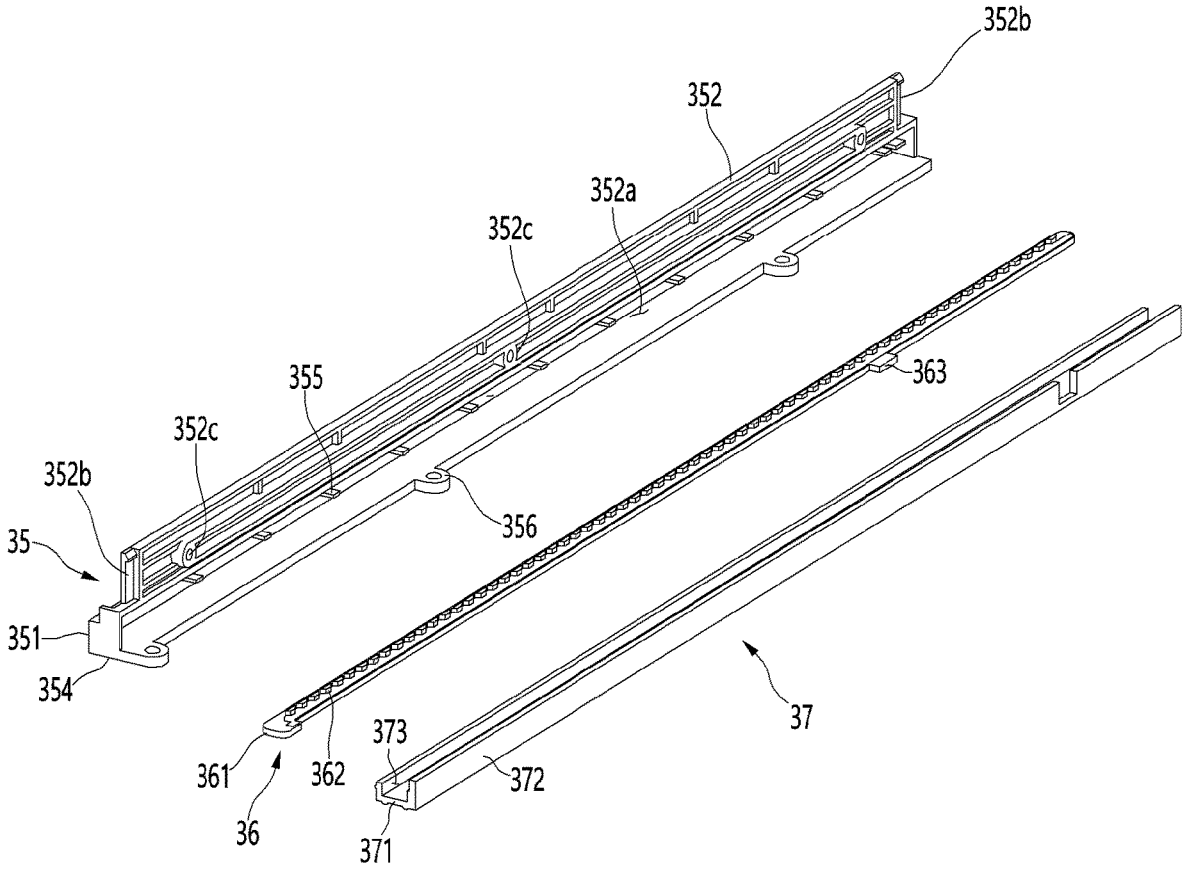
FIG. 10 is an exploded perspective view illustrating a coupling structure of the lower bracket, a lighting device, and a light supporter.
Figure 11:
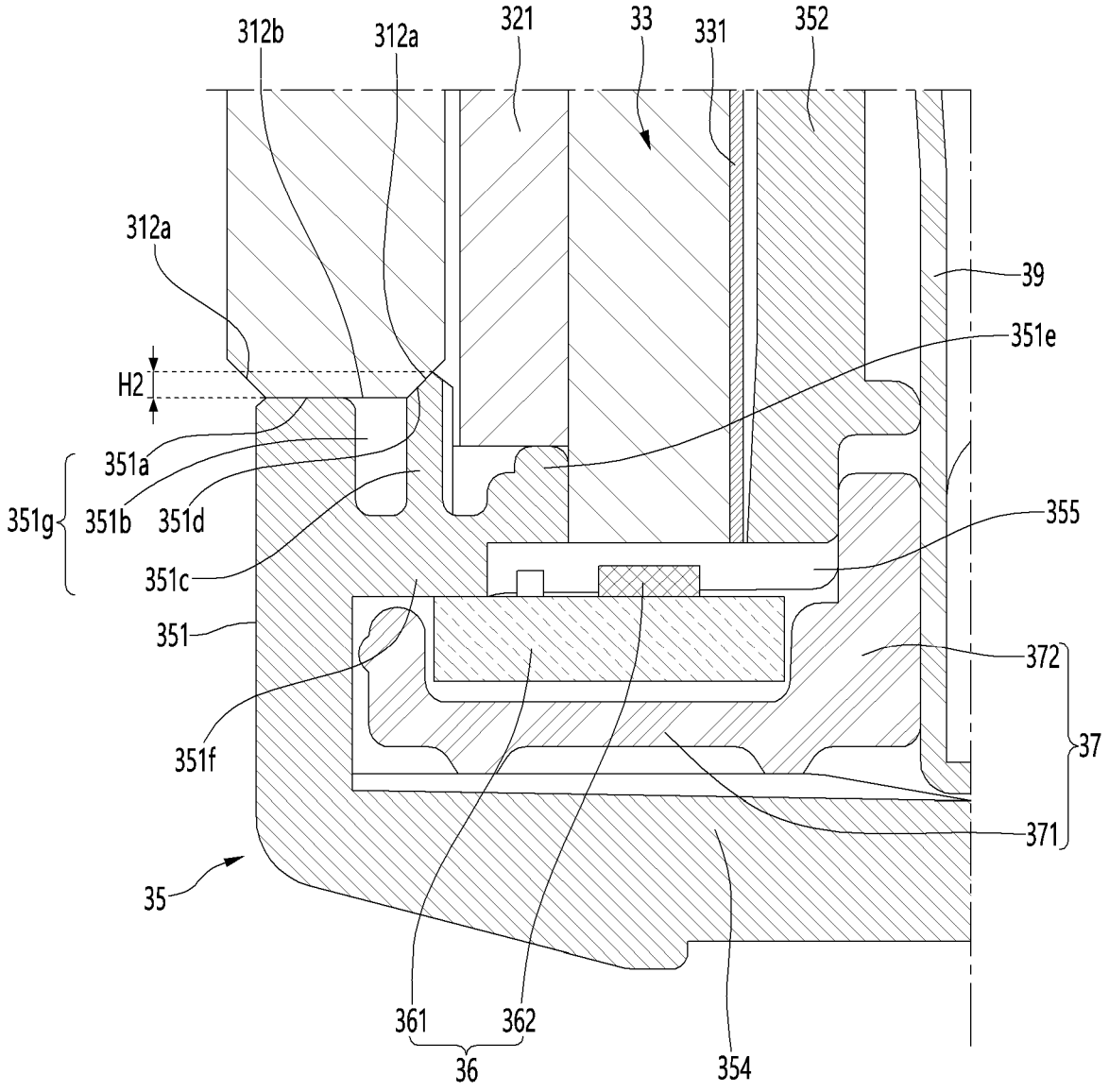
FIG. 11 is a cross-sectional view taken along line XI-XI' of FIG. 4.

Also, FIG. 9 is an exploded perspective view illustrating a coupling structure of the mounting member, the lower bracket, and the back cover, which constitute the panel assembly. FIG. 10 is an exploded perspective view illustrating a coupling structure of the lower bracket, a lighting device, and a light supporter. Also, FIG. 11 is a cross-sectional view taken along line XI-XI' of FIG. 4.

As illustrated in the drawings, the lower bracket 35 may include a lower bracket front surface portion 351, a lower bracket rear surface portion 352, a lower bracket side surface portion 353, and a lower bracket bottom surface portion 354.

The lower bracket front surface portion 351 may define a shape of the front surface of the lower bracket 35 and may support the lower end of the panel 31 and also cover the lighting device 36.

The lower bracket 35 may include a lower support portion 351*a*. In detail, the lower support portion 351*a* protruding upward to support the bottom surface of the panel 31 may be disposed on the upper end of the lower bracket front surface portion 321. Here, the lower support portion 351*a* may be disposed at a position higher than the lighting device 36 and may protrude higher than the lower end of each of the mounting member 32 and the light guide plate 33. Thus, the lower bracket front surface portion 321 may strongly irradiate light at a position adjacent to the lighting device 36 to prevent the light from flashing at the lower end of the panel 31. Since the lower support portion 351*a* may support the panel 31, the lower support portion 351*a* may be referred to as a support portion.

The lower end of the panel 31 may include a panel bottom surface 312*b* and a panel inclined surface 312*a*. The panel bottom surface 312*b* may define a surface crossing the front surface of the panel 31 and may be in contact with the lower support portion 351*a*. The panel bottom surface 312*b* may be provided in a planar shape to be in surface contact with the lower support portion 351*a* and may ensure stable support of the panel 31.

In addition, the panel inclined surface 312*a* may be disposed on each of front and rear ends of the panel bottom surface 312*b*. The panel inclined surface 312*a* may extend forward and rearward from the front and rear ends of the panel bottom surface 312*b* and may be provided to increase in height as being extends forward and rearward. An impact or load applied to an edge of the panel 31 may be dispersed by the panel inclined surface 312*a*. The panel inclined surface 312*a* may be provided in a rounded shape or may be disposed only on the rear end of the front and rear ends of the panel bottom surface 312*b*.

The lower bracket 35 may include a lower blocking portion 351*c*. The lower blocking portion 351*c* may be disposed at a rear side spaced apart from the lower bracket front surface portion 321 and may extend in the vertical direction. The lower blocking portion 351*c* may be provided in a rib shape extending in the vertical direction and thus may be referred to as a shielding rib. In addition, the lower blocking portion 351*c* may be provided in a rib shape extending in the vertical direction and thus may be referred to as a shielding rib. In addition, since the lower blocking portion 351*c* blocks light from leaking between the lower end of the panel 31 and the lower bracket 35, the lower blocking portion 351*c* may also be called a blocking portion.

In addition, both the lower support portion 351*a* and the lower blocking portion 351*c* may protrude upward from the lower bracket 35. Thus, both the lower support portion 351*a* and the lower blocking portion 351*c* may be referred to as a lower bracket protrusion 351*g*. In addition, the lower bracket protrusion 351*g* may be referred to as a bracket protrusion.

The bracket protrusion may be disposed on both the upper bracket 34 and the lower bracket 35. In addition, the bracket protrusion may be disposed only on one of the upper bracket 34 and the lower bracket 35.

In addition, a space 351*b* may be defined between the lower bracket front surface portion 321 and the lower blocking portion 351*c*. That is, the lower support portion 351*a* and the lower blocking portion 351*c* may be defined by a space recessed downward from a top surface of the lower bracket front surface portion 321. That is, the lower support portion 351*a* and the lower blocking portion 351*c* may be disposed on the lower bracket front surface portion 321.

The lower blocking portion 351*c* may extend upward from a rear side of the lower support portion 351*a* and may extend further than the lower support portion 351*a* so as to be in contact with the panel inclined surface 312*a*. In addition, the top surface 351*d* of the lower blocking portion 351*c* may be inclined and may have an inclination that is in surface contact with the panel inclined surface 312*a*.

The lower blocking portion 351*c* may be disposed behind the lower support portion 351*a* and may protrude upward more by a set height h2 than the lower support portion 351*a*. In addition, an upper end of the lower support portion 351*a* may protrude up to a position higher than a lower end of the lighting device 36 as well as a lower end of the mounting member 32 and a lower end of the light guide plate 33. In addition, the lower blocking portion 351*c* may extend upward more than the lower end of the panel 31 on the basis of the panel 31.

Thus, the lower blocking portion 351*c* may block the light irradiated from the rear side from passing between the lower end of the panel 31 and the lower support portion 351*a*. In addition, when the panel assembly 30 is viewed in the state in which the lighting device 36 is turned on, the light may be prevented from leaking between the lower end of the panel 31 and the lower bracket 35.

The lower bracket 35 may include a light guide plate restriction portion 351*e*. The light guide plate restriction portion 351*e* may be disposed at a rear side that is away from the lower blocking portion 351*c*. The light guide plate restriction portion 351*e* may be disposed in front of a light source 362 of the lighting device 36 and may be disposed lower than the lower support portion 351*a* and the lower blocking portion 351*c*. In addition, forward and backward movement of the light guide plate 33 may be restricted by being in contact with the lower end of the front surface of the light guide plate 33.

A lower connection portion 351*f* protruding backward may be disposed on the rear surface of the lower bracket front portion 321. The lower connection portion 351*f* may extend into an inner space of the lower bracket 35, in which the lighting device 36 is accommodated, and may connect the lower bracket front surface portion 321, the lower blocking portion 351*c*, and the light guide plate restriction portion 351*e* to each other. In addition, the lower connection portion 351*f* may restrict the lighting device 36 at the upper side to restrict vertical movement of the lighting device 36.

The lower bracket rear surface portion 352 may be disposed at a position spaced backward from the lower bracket front surface portion 351. The lower bracket rear surface portion 352 may define a rear surface of the lower bracket 35 and may protrude more upward than the lower bracket front surface portion 351 and the lower bracket side surface portion 353 to support the light guide plate 33 at the rear side and then may be coupled to the back cover 39.

A lower bracket mounting portion 352*b* that is disposed to be stepped forward may be disposed on each of both left and right ends of the lower bracket rear surface portion 352. The lower bracket mounting portion 352*b* may be inserted from a lower side of the bracket insertion space 325.

A lower bracket screw hole 352*c* to which a plurality of screws 397*a* are coupled may be defined in the lower bracket rear surface portion 352. When the back cover 39 is mounted, the screw 397*a* may be coupled to sequentially pass through the cover screw hole 397*a* and the lower bracket screw hole 397.

A bracket opening 352*a* may be defined in the lower bracket rear surface portion 352. The lighting device 36 may be accessible through the bracket opening 352*a*. The bracket opening 352*a* may be shielded by the back cover 39.

The lower bracket bottom surface portion 354 may define a bottom surface of the lower bracket 35 and may define a bottom surface of the space in which the lighting device 36 is mounted. In addition, the bracket support portion 356 protruding backward may be disposed on a rear end of the lower bracket bottom surface portion 354. The bracket support portion 356 may protrude further backward than the lower bracket rear portion 352, and the cover support portion 396 protruding from the lower end of the back cover 39 may be seated on the bracket support portion 356. Thus, the bracket support portion 356 and the cover support portion 396 may be supported on or inserted in a lower end of the lower cap decoration 45 when the panel assembly 30 is mounted to fix the lower end of the panel assembly 30.

The light guide plate support portion 355 supporting the lower end of the light guide plate 33 may be provided in plurality on the lower bracket 35. The lower end of the light guide plate 33 may be supported by the light guide plate support portion 355 to maintain a distance from the lighting device 36.

The lighting device 36 may be provided within the lower bracket 35. The lighting device 36 may include a substrate 361 and a light source 362. The substrate 361 may be accommodated in the lower bracket 35, and a plurality of light sources 362 may be continuously disposed at regular intervals on the substrate 361.

The light source 362 may be disposed to emit light toward the lower end of the light guide plate 33. An example of the light source 362 may include an LED. The light source 362 may include an RGB LED for emitting light with various colors under the control of the controller. That is, the light source 362 may emit light of various colors according to a user's manipulation, and thus the panel 31 may shine in a color set by the user. In addition, a color of an outer appearance of the front surface of the refrigerator 1 may be determined according to the color of the panel 31.

A substrate connection portion 363 protruding backward may be disposed at one side of the substrate 361, and an electric wire may be connected to the substrate connection portion 363. The substrate connection portion 363 may protrude to be exposed through a wire entrance 398 defined in the back cover 39, and the wire may enter and exit through the wire entrance 398.

A light supporter 37 may be provided under the substrate 361. The light supporter 37 may include a horizontal portion 371 and a vertical portion 372. The horizontal portion 371 may define a bottom surface of the light supporter 37 and may be disposed below the substrate 361 to support the substrate 361. Here, a supporting groove 373 in which at least a portion of the substrate 361 is accommodated may be defined in the horizontal portion 371.

When the back cover 39 is mounted on the lower bracket 35, the vertical portion 372 exposed through the bracket opening 352*a* may be in contact with the front surface of the back cover 39. Thus, heat from the substrate 361 may be transferred to the back cover 39 through the light supporter 37 and may be radiated through the entire rear surface of the panel assembly 30.

Hereinafter, the operations of the refrigerator 1 and the panel assembly 30 having the above structures will be described in more detail with reference to the drawings.

Figure 12:
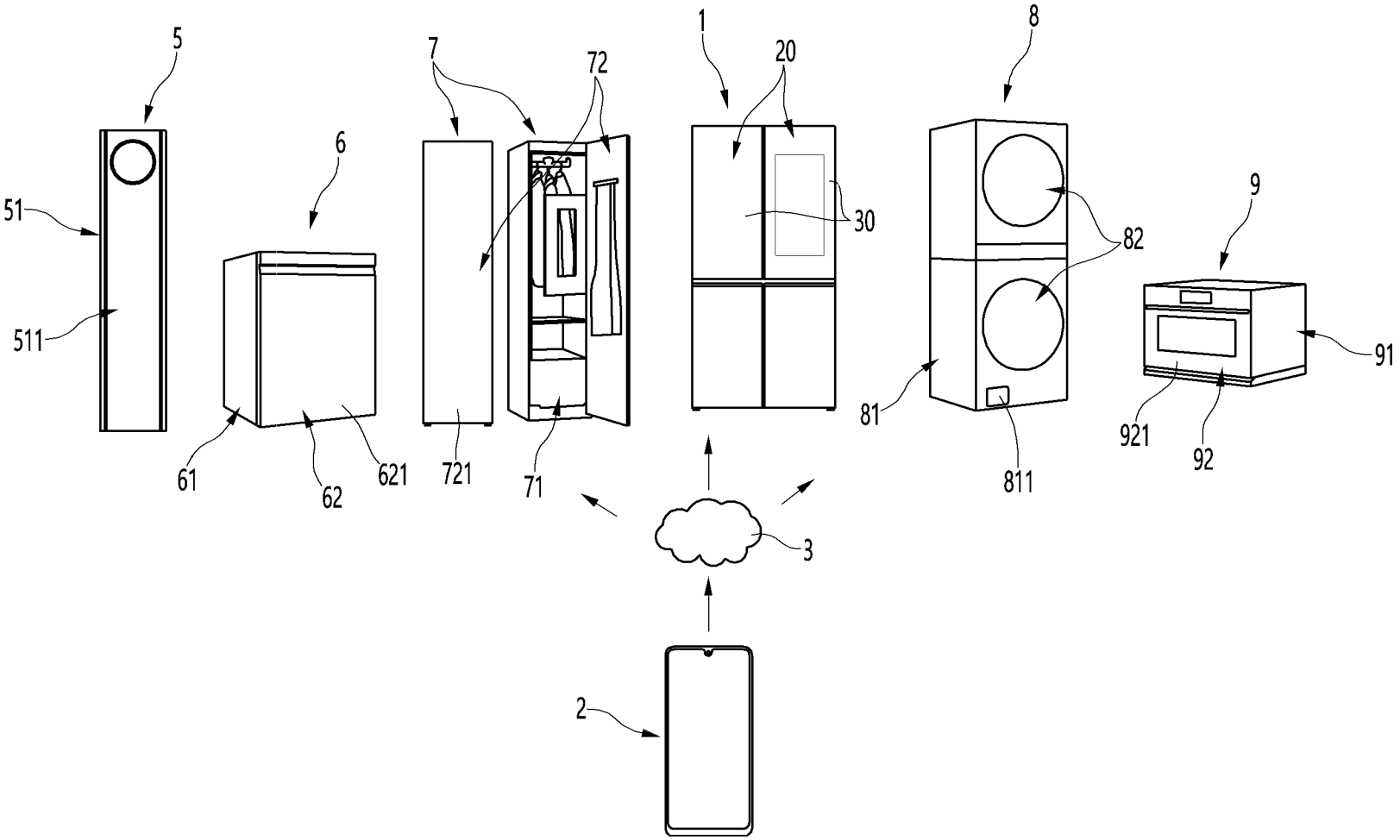
FIG. 12 is a view illustrating an example of adjusting colors of home appliances to which the panel assembly using a remote device is applied.
Figure 13:
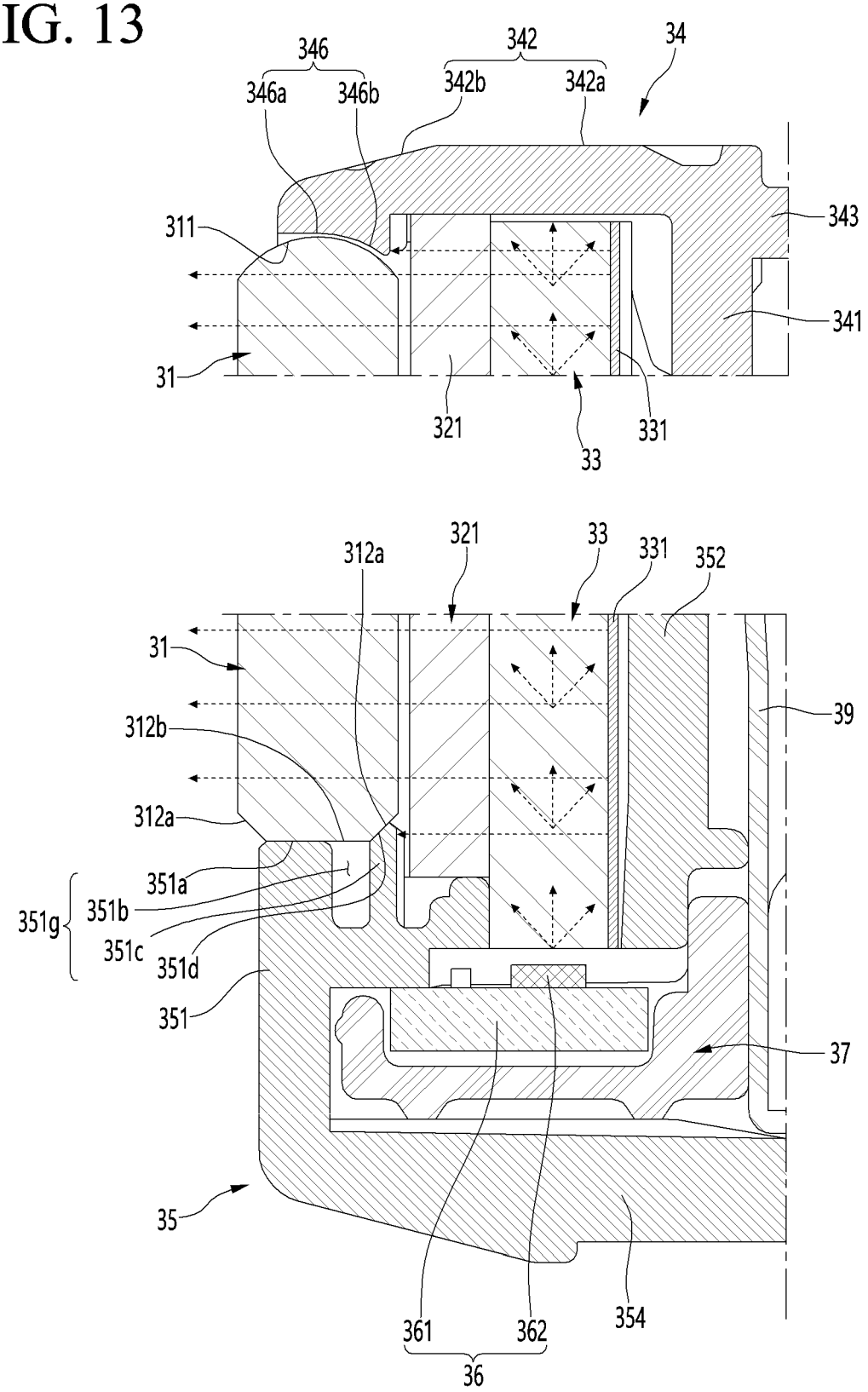
FIG. 13 is a cross-sectional view illustrating an emission state of the panel assembly.
Figure 14:
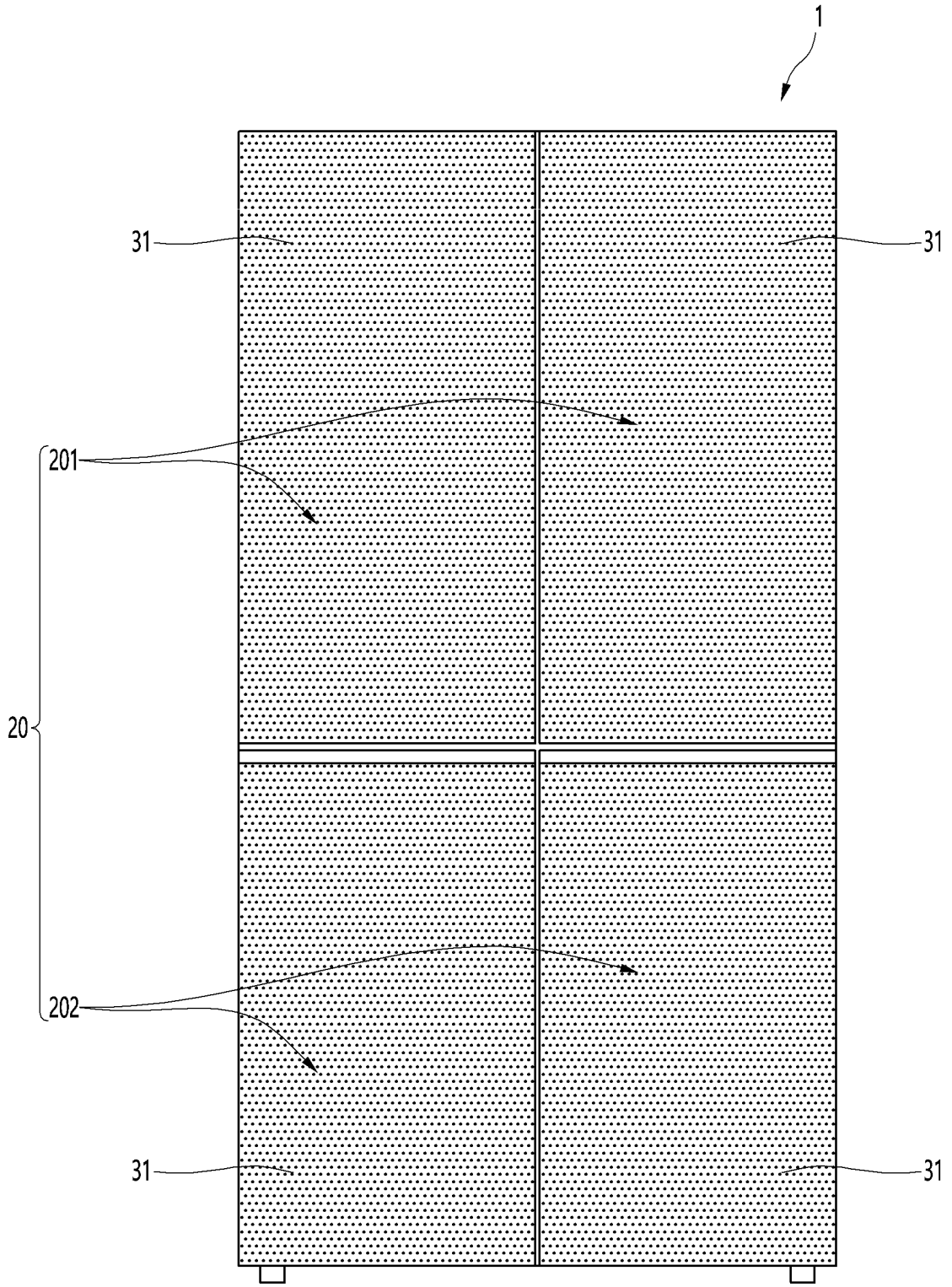

FIG. 12 is a view illustrating an example of adjusting colors of home appliances to which the panel assembly using a remote device is applied. Also, FIG. 13 is a vertical cross-sectional view illustrating an emission state of the panel assembly. Also, FIG. 14 is a front view illustrating an outer appearance of the front surface of the refrigerator that is in a state in which the lighting device is turned on.

As illustrated in the drawing, an outer appearance of the home appliance according to an embodiment may be defined by the panel assembly 30, and also, a color of the outer appearance of the home appliance may be changed to a color that is set by the user according to the operation of the lighting device 36. The panel assembly may be expressed in various colors by light irradiated from the rear side, and thus the panel assembly 30 or the panel 31 may be referred to as a screen.

The home appliance may be any one of a refrigerator 1, an air conditioner 5, a dishwasher 6, a clothes manager 7, a washing machine 8, or a cooking appliance 9, each of which has a front surface of which a color of an outer appearance is freely changed by applying the same structure as the panel assembly 30 according to an embodiment.

For example, in the above-described embodiment and in the refrigerator 1, the panel assembly 30 may be provided on a front side of the door 20 that opens and closes the cabinet 10. In addition, the panel assembly 30 may shine in a set color by user setting, and the outer appearance of the front surface of the refrigerator 1 may be changed in color.

As another example, an indoor unit of the air conditioner 5 may have a space in which a heat exchange device and a fan are provided inside a case 51 (or cabinet) that defines an outer appearance of the indoor unit. In addition, a front surface of the case 51 may be defined by a panel assembly 511. The panel assembly 511 may have the same structure as the panel assembly 30 of the refrigerator 1 to emit light.

Thus, the panel assembly 511 may shine in a set color by the user setting, and a color of the outer appearance of the front surface of the indoor unit of the air conditioner 5 may be changed into the set color.

As another example, in the dishwasher 6, a space for washing dishes may be defined inside a case 61 or a cabinet that defines an outer appearance of the dishwasher 6. In addition, the front surface of the case 61 may be opened and closed by the door 62, and the front surface of the door 62 may be defined by the panel assembly 621. The panel assembly 621 may have the same structure as the panel assembly 30 of the refrigerator 1 to emit light.

Thus, the panel assembly 621 may shine in a set color by the user setting, and a color of the outer appearance of the front surface of the dishwasher 6 may be changed into the set color.

As another example, in the clothes manager 7, a space for storing clothes may be defined inside a case 71 or a cabinet that defines an outer appearance of the clothes manager 7. In addition, the front surface of the case 71 may be opened and closed by the door 72, and the front surface of the door 72 may be defined by the panel assembly 721. The panel assembly 721 may have the same structure as the panel assembly 30 of the refrigerator 1 to emit light.

Thus, the panel assembly 721 may shine in a set color by the user setting, and a color of the outer appearance of the front surface of the clothes manager 7 may be changed into the set color.

As another example, in the washing machine 8 or a dryer, a space for washing or drying may be defined inside a case 81 (or cabinet) that defines an outer appearance of the washing machine 8. In addition, a front of the case 81 may be opened and closed by the door 82. The front surface of the case 81 may be defined by a panel assembly 811. The panel assembly 811 may have the same structure as the panel assembly 30 of the refrigerator 1 to emit light.

Thus, the panel assembly 30 may shine in a set color by the user setting, and a color of the outer appearance of the front surface of the washing machine 8 or the dryer of the air conditioner 8 may be changed into the set color.

As another example, in the cooking appliance 9, a space for cooking food may be defined inside a case 91 or a cabinet that defines an outer appearance of the cooking appliance. In addition, the front surface of the case 91 may be opened and closed by the door 92, and the front surface of the door 92 may be defined by the panel assembly 921. The panel assembly 921 may have the same structure as the panel assembly 30 of the refrigerator 1 to emit light.

Thus, the panel assembly 921 may shine in a set color by the user setting, and a color of the outer appearance of the front surface of the cooking appliance 9 may be changed into the set color.

A process of changing the color of the panel assembly 30 will be described below.

In a state in which the lighting device 36 is turned off, a color of the outer appearance of the front surface may be expressed by the color of the panel 31. A color displayed on the panel 31 in the state in which the lighting device 36 is turned off may be referred to as a first color.

When the lighting device 36 operates, the color of the panel 31 may be changed according to a color of light irradiated from the lighting device 36, and a color of the outer appearance of the front surface of the door 20 may be expressed in the selected color. Here, the color displayed through the panel by the light irradiated from the lighting device 36 may be referred to as a second color.

The color of the panel 31 may be determined by an operation of the lighting device 36. For example, the lighting device 36 may also be manipulated and set through a remote device 2 spaced apart from the refrigerator 1. The refrigerator 1 may communicate with the remote device 2 through a communicator 17 connected to a controller 13, and the user may manipulate an operation of the lighting device 36 through the remote device 2.

The communicator 17 may communicate with the remote device 2 using various methods. For example, the remote device 2 may be various devices that are capable of communicating, such as a dedicated terminal, a mobile phone, a tablet, a portable PC, a desktop PC, a remote control, or a Bluetooth speaker.

The user may manipulate and set the overall operation state of the lighting device 36, such as an operation time and an operation condition of the lighting device 36 and emission color through manipulation of the remote device 2. For example, the lighting device 36 may be simply manipulated and set through an application or a dedicated program installed in a portable phone of the user. In addition, the user may input a color through a manipulation portion provided in the refrigerator 1 without using the remote device 2.

In addition, each of the refrigerator 1 and the remote device 2 may be connected to a server in a network state, and thus, the color of the panel 31 of the refrigerator 1 may be input through the server 3.

The operation state of the lighting device 36 is now described. As illustrated in FIG. 13, when the lighting device 36 is turned on according to the control of the controller, light emitted from the LED 362 may be emitted toward the lower end of the light guide plate 33.

The light incident through the lower end of the light guide plate 33 may be diffused and reflected along the light guide plate 33 and then may move along the light guide plate 33. In this case, the light guided by the light guide plate 33 may be reflected forward by the reflective layer 331 to pass through the panel 31 so as to be transmitted to the outside.

Light directed forward through the light guide plate 33 may pass through the mounting member 32 to illuminate the panel 31, and the front surface of the door 20 may shine with a set brightness or color.

For example, in the state in which the lighting device 36 is turned off, as illustrated in FIG. 1, a front surface of the door 20 may not shine, and an original color of the panel assembly 30 may appear.

The panel assembly 30 may have a structure that is separable from the door body 40, and thus, the user may select a color of the first panel 31 by mounting the panel assembly 30 having a desired color. Of course, if necessary, the user may change the color of the panel 31 when the lighting device 36 is turned off by exchanging the panel assembly 30 itself.

Thus, the front surface of the door 20 may be seen with the first color that is the color of the panel 31. In this case, components inside the panel assembly 30 may be seen through the panel 31 and may not be seen to the outside by the color of the panel 31.

In this state, the lighting device 36 may be turned on, and when the lighting device 36 is turned on, the front surface of the door 20 may shine with a color set by the user.

For example, as illustrated in FIG. 14, the controller may control the front surface of the door 20 to shine with a second color different from the first color, and the lighting device 36 may cause the LED 362 to shine with the set color according to the control of the controller. Here, the color of the panel 31 may be selected by the user, and the color of the panel 31 may be selected by the manipulation of the remote device 2 or the manipulation of the manipulation portion 14.

In the state in which the outer appearance of the front surface of the refrigerator 1 shines with the set color, when the controller instructs change in color of the front surface of the refrigerator 1, the front surface of the panel 31 may shine with a color that is reset by the controller.

In addition, the panels 31 constituting some of the plurality of doors 20 defining the outer appearance of the front surface of the refrigerator 1 may emit light, or the panels 31 constituting the plurality of doors 20 may independently emit light with different colors to define the outer appearance of the front surface of the refrigerator 1.

When the lighting device 36 is turned on, and the panel 31 shines with a set color, the entire front surface of the panel 31 shines with uniform brightness and color. That is, the quality of the outer appearance may be prevented from being deteriorated when the light leaks through the gap of the circumference of the panel 31 without passing through the panel 31, and thus, the light has a color different from that of the front surface of the panel 31 or have brightness different from that of the front surface of the panel 31.

In detail, the upper blocking portion 346*b* of the upper bracket 34 may block the light irradiated from the rear side at a portion at which the upper end of the panel 31 and the upper bracket 34 are in contact with each other. The upper blocking portion 346*b* may extend further downward than the upper support portion 346*a* to prevent the light from leaking into a gap between the upper end of the panel 31 and the upper support portion 346*a*. Here, the upper blocking portion 346*b* may not extend further downward beyond the rounded top surface 311 of the panel to prevent the light from leaking without darkening the brightness of the circumference of the front surface of the panel 31.

In addition, the lower blocking portion 351*c* of the lower bracket 35 may block the light irradiated from the rear side at a portion at which the lower end of the panel 31 and the lower bracket 35 are in contact with each other. The lower blocking portion 351*c* may extend upward more than the lower support portion 351*a* to prevent the light from leaking through the gap between the lower panel surface 312*b* and the lower support portion 351*a*. Here, the lower blocking portion 351*c* may not extend upward beyond the inclined panel inclined surface 312*a* to prevent the light from leaking without darkening the brightness of the circumference of the front surface of the panel 31.

That is, an upper blocking portion 346*b* and a lower blocking portion 351*c*, which extend inward (vertical direction) from the rear side of the panel 31 may be disposed on the upper bracket 34 and the lower bracket 35 on the basis of the panel 31, respectively, to prevent the light from shining on the upper and lower ends of the panel 31.

There may be various other embodiments other than the aforementioned embodiments. In another embodiment of the present disclosure, the side blocking portion may be disposed on the mounting member to block the light from leaking through both side surfaces of the mounting member. Another embodiment of the present disclosure may have the same structure as the aforementioned embodiment except for a structure in which the blocking portion is added, and thus the same components as in the aforementioned embodiment use the same reference numeral, and a detailed description and illustration thereof may be omitted.

Hereinafter, another embodiment of the present disclosure will be described with reference drawings.

Figure 15:
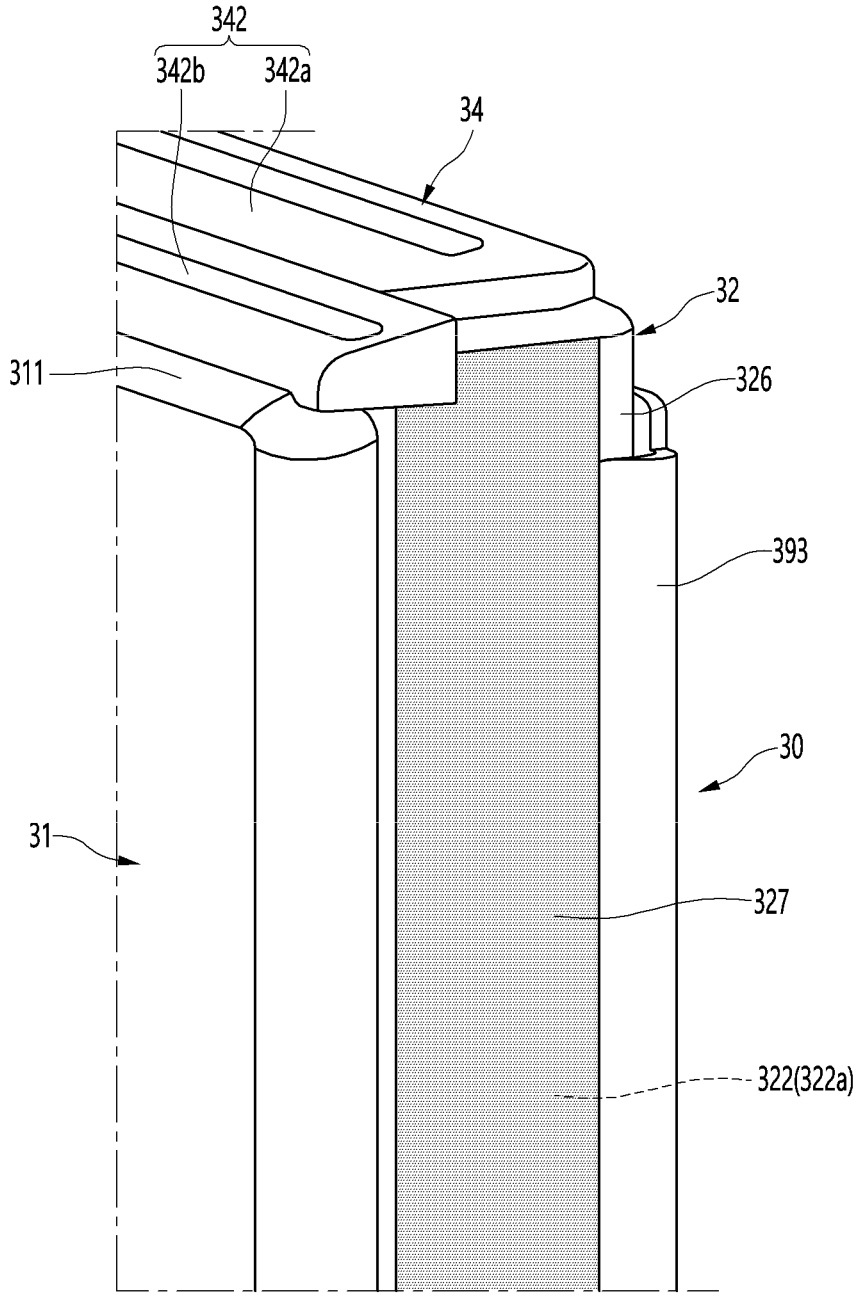
FIG. 15 is a partial perspective view of a panel assembly according to a second embodiment.

FIG. 15 is a partial perspective view of a panel assembly according to a second embodiment.

As illustrated in the drawing, a panel assembly according to the second embodiment may have the same structure as in the foregoing embodiment and may have a structure including a panel 31, a mounting member 32, a light guide plate 33, a lighting device 36, an upper bracket 34, a lower bracket 35, and a back cover 39.

In a state in which the mounting member 32 is assembled, a front surface portion 321 may be covered by the panel 31, and a side surface portion 322 may be exposed to a side of the panel assembly 30. Particularly, a first part 322*a* of the side surface portion 322 may be exposed to both left and right sides of the panel assembly 30 to define left and right surfaces of the panel assembly 30.

Here, left and right ends of the first part 322*a* may protrude up to the same extension line as left and right ends of the panel 31. In addition, the left and right ends of the first part 322*a* may protrude more than the left and right side ends of the panel 31.

The mounting member 32 may be made of a material that allows light to be transmitted therethrough, and thus, some of the light irradiated forward by the light guide plate 33 may leak to a side of the panel assembly 30 through the side surface portion 322.

Thus, in this state, a side blocking portion 327 may be further disposed on the side surface portion 322 to block the light from leaking through the side surface portion 322. The side blocking portion 327 may be opaquely provided on a surface of the side surface portion 322 to prevent the light from being transmitted through the side surface portion 322.

The side blocking portion 327 may prevent the light from leaking by being printed, deposited, or applied with an opaque paint. In addition, the side blocking portion 327 may prevent the light from being transmitted through the surface treatment. Since the side blocking portion 327 provides a separate layer on the mounting member 32, the side blocking portion 327 may be referred to as a blocking layer.

The side blocking portion 327 may be disposed on only the first part 322*a* of the side surface portion 322. In addition, the side blocking portion 327 may be disposed on only a portion exposed to the outside in the state in which the panel assembly 30 is assembled. That is, the side blocking portion 327 may be partially disposed on an area excluding the cover restriction groove 326 rather than the entire first part 322*a* and may also be disposed on portions of the upper and lower ends of the side surface portion 322, which are not covered when the upper bracket 324 and the lower bracket 325 are coupled.

In addition, a color of the side blocking portion 327 may be expressed as a color different from that of the mounting member 32 and may have the same as a first color of the panel 31.

Figure 16:
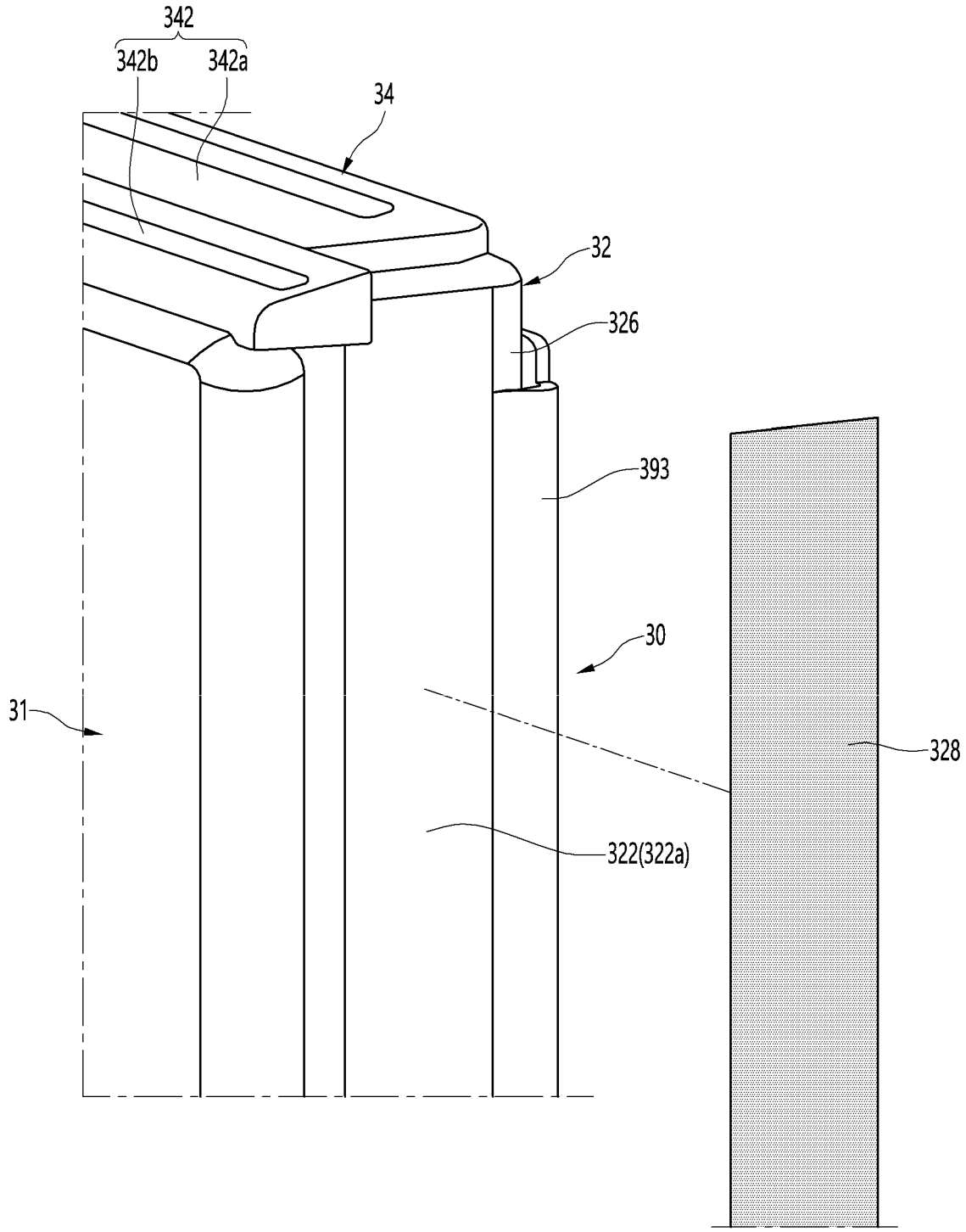
FIG. 16 is a partial perspective view of a panel assembly according to a third embodiment.

FIG. 16 is a partial perspective view of a panel assembly according to a third embodiment.

As illustrated in the drawing, a panel assembly according to the third embodiment may have the same structure as in the foregoing embodiment and may have a structure including a panel 31, a mounting member 32, a light guide plate 33, a lighting device 36, an upper bracket 34, a lower bracket 35, and a back cover 39.

In a state in which the mounting member 32 is assembled, a front surface portion 321 may be covered by the panel 31, and a side surface portion 322 may be exposed to a side of the panel assembly 30. Particularly, a first part 322*a* of the side surface portion 322 may be exposed to both left and right sides of the panel assembly 30 to define left and right surfaces of the panel assembly 30.

Here, left and right ends of the first part 322*a* may protrude up to the same extension line as left and right ends of the panel 31. In addition, the left and right ends of the first part 322*a* may protrude more than the left and right side ends of the panel 31.

The mounting member 32 may be made of a material that allows light to be transmitted therethrough, and thus, some of the light irradiated forward by the light guide plate 33 may leak to a side of the panel assembly 30 through the side surface portion 322.

Thus, in this state, a side blocking portion 328 may be further disposed on the side surface portion 322 to block the light from leaking through the side surface portion 322. The side blocking portion 328 may be attached to an outer surface of the side surface portion 322 to prevent light from being transmitted through the side surface portion 322.

The side blocking portion 328 may be made of an opaque material, may be provided in a sheet or plate shape, and may be attached to the side surface portion 322. Since the side blocking portion 328 has a structure attached to the mounting member 32 in a separately molded state, the side blocking portion 328 may be called a blocking member or a blocking sheet.

The side blocking portion 328 may be provided in a shape corresponding to the first part 322*a* of the side surface portion 322. In addition, the side blocking portion 328 may be provided in a shape corresponding to a portion exposed to the outside in the state in which the panel assembly 30 is assembled. That is, the side blocking portion 328 may be provided in a shape corresponding to that of the remaining portion excluding the cover restriction groove 326 rather than the entire first part 322*a* and may also be provided in a shape that is also capable of shielding portions of upper and lower ends of the side surface portion 322, which are not covered when the upper bracket 324 and the lower bracket 325 are coupled.

In addition, a color of the side blocking portion 328 may be expressed as a color different from that of the mounting member 32 and may have the same as a first color of the panel 31.

Figure 17:
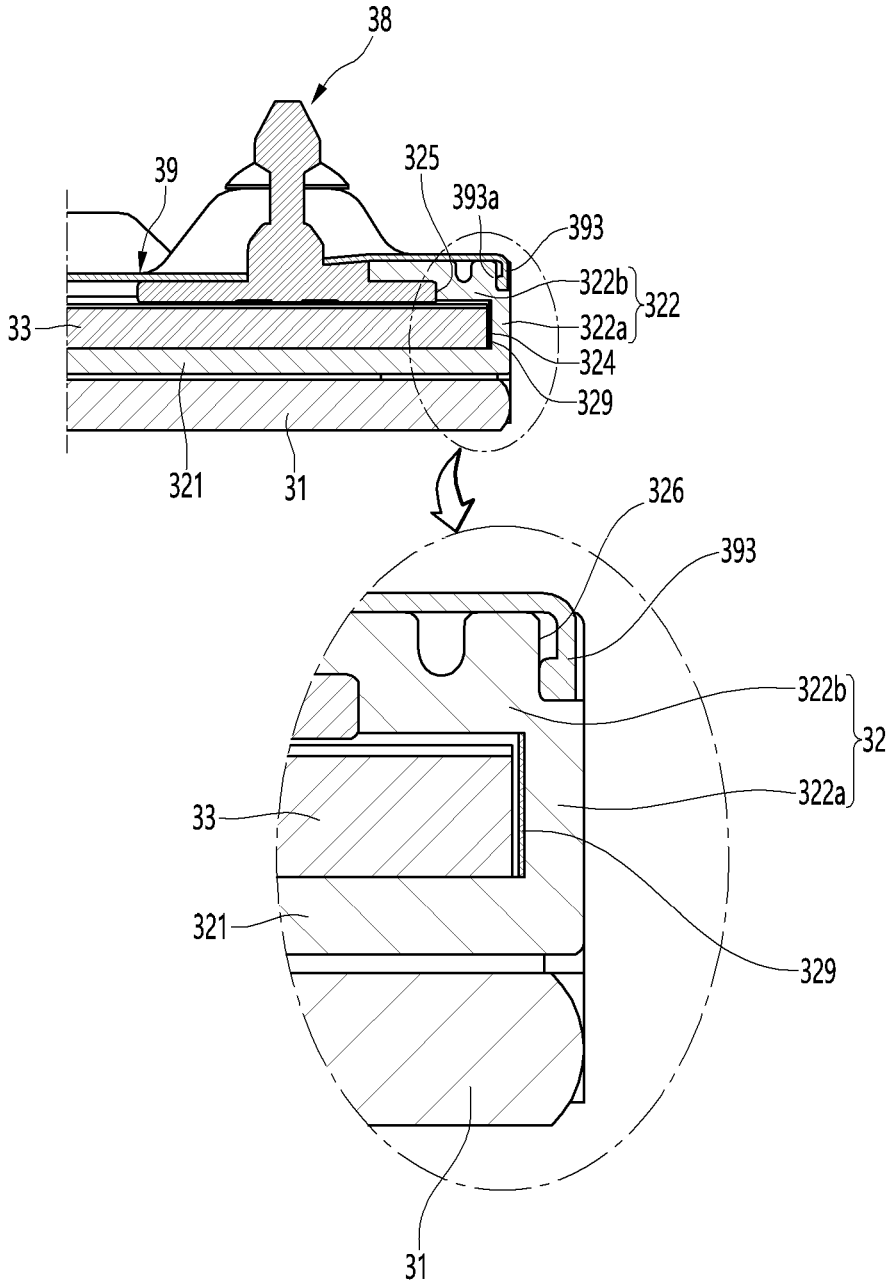
FIG. 17 is a partial perspective view of a panel assembly according to a fourth embodiment.

FIG. 17 is a partial perspective view of a panel assembly according to a fourth embodiment.

As illustrated in the drawing, a panel assembly according to the fourth embodiment may have the same structure as in the foregoing embodiment and may have a structure including a panel 31, a mounting member 32, a light guide plate 33, a lighting device 36, an upper bracket 34, a lower bracket 35, and a back cover 39.

In a state in which the mounting member 32 is assembled, a front surface portion 321 may be covered by the panel 31, and a side surface portion 322 may be exposed to a side of the panel assembly 30. Particularly, a first part 322*a* of the side surface portion 322 may be exposed to both left and right sides of the panel assembly 30 to define left and right surfaces of the panel assembly 30.

Here, left and right ends of the first part 322*a* may protrude up to the same extension line as left and right ends of the panel 31. In addition, the left and right ends of the first part 322*a* may protrude more than the left and right side ends of the panel 31.

The mounting member 32 may be made of a material that allows light to be transmitted therethrough, and thus, some of the light irradiated forward by the light guide plate 33 may leak to a side of the panel assembly 30 through the side surface portion 322.

Thus, in this state, a side blocking portion 329 may be further disposed on the side surface portion 322 to block the light from leaking through the side surface portion 322. The side blocking portion 329 may be opaquely provided on an inner surface of the side surface portion 322 to prevent the light from being transmitted through the side surface portion 322.

The side blocking portion 329 may prevent the light from leaking by being printed with opaque paint or provided by deposition, coating, or the like. In addition, the side blocking portion 329 may prevent the light from being transmitted through the surface treatment. Since the side blocking portion 329 provides a separate layer on the mounting member 32, the side blocking portion 327 may be referred to as a blocking layer.

In addition, the side blocking portion 329 may be made of an opaque material, may be provided in a sheet or plate shape, and may be attached to the side surface portion 322. Since the side blocking portion 329 has a structure attached to the mounting member 32 in a separately molded state, the side blocking portion 328 may be called a blocking member or a blocking sheet.

The side blocking portion 329 may be disposed on an inner surface of the side surface portion 322. That is, the side blocking portion 329 may be disposed on an inner surface of a light guide plate insertion space 324 of the mounting member 32. Thus, light transmitted through the side surface portion 322 may be blocked inside the mounting member 32. The side blocking portion 329 may be disposed on only an inner surface of the side surface portion 322 facing both ends of the light guide plate 33.

In addition, a color of the side blocking portion 329 may be expressed as a color different from that of the mounting member 32 and may have the same as a first color of the panel 31.

Figure 18:
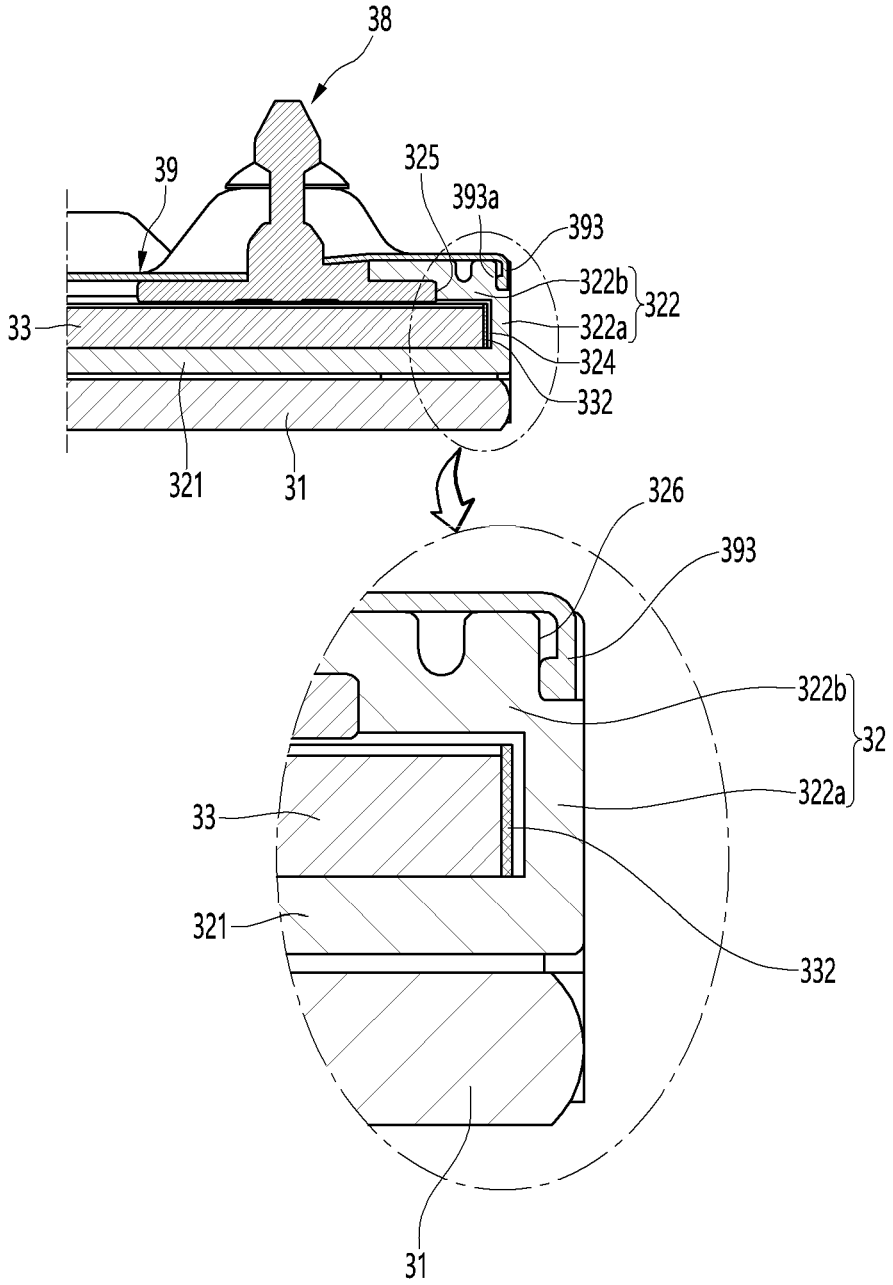
FIG. 18 is a partial perspective view of a panel assembly according to a fifth embodiment.

FIG. 18 is a partial perspective view of a panel assembly according to a fifth embodiment.

As illustrated in the drawing, a panel assembly according to the fifth embodiment may have the same structure as in the foregoing embodiment and may have a structure including a panel 31, a mounting member 32, a light guide plate 33, a lighting device 36, an upper bracket 34, a lower bracket 35, and a back cover 39.

In a state in which the mounting member 32 is assembled, a front surface portion 321 may be covered by the panel 31, and a side surface portion 322 may be exposed to a side of the panel assembly 30. Particularly, a first part 322*a* of the side surface portion 322 may be exposed to both left and right sides of the panel assembly 30 to define left and right surfaces of the panel assembly 30.

Here, left and right ends of the first part 322*a* may protrude up to the same extension line as left and right ends of the panel 31. In addition, the left and right ends of the first part 322*a* may protrude more than the left and right side ends of the panel 31.

The mounting member 32 may be made of a material that allows light to be transmitted therethrough, and thus, some of the light irradiated forward by the light guide plate 33 may leak to a side of the panel assembly 30 through the side surface portion 322.

Thus, in this state, a side blocking portion 332 may be further disposed on the side surface portion 322 to block the light from leaking through the light guide plate 33. The side blocking portion 332 may be disposed along both left and right surfaces of the light guide plate 33 and may shield the entire left and right surfaces of the light guide plate 33.

The side blocking portion 332 may be printed with an opaque paint or provided to block light by deposition, coating, or the like. In addition, the side blocking portion 332 may be provided in a sheet or plate shape and attached to a side surface of the light guide plate 33.

In addition, the side blocking portion 332 may be made of the same material as a reflective layer 331 and may be attached to the side surface of the light guide plate 33 to prevent light from being irradiated to a side of the light guide plate 33 and also prevent the light from being reflected again to the inside of the light guide plate 33. The side blocking portion 332 may be referred to as a side reflection layer.

The light guide plate 33 may be irradiated only forward by the side blocking portion 332, and thus, the light may be prevented from leaking laterally through the side surface of the panel assembly 30, i.e., the side surface portion 322.

The home appliance according to the proposed embodiments may have the following effects.

According to the embodiment, when the lighting device is turned on, and thus, the panel shines with the set color, the light may be prevented from leaking through the circumference other than the front surface of the panel, and the entire panel may uniformly shine to improve the quality of the outer appearance.

Particularly, there may be the advantage of preventing the quality of the outer appearance from being deteriorated when the light leaks through the circumference of the panel without passing through the panel, and thus, the light has a color different from that of the front surface of the panel or have brightness different from that of the front surface of the panel.

In addition, the upper bracket and the lower bracket may provide the upper blocking portion and the lower blocking portion, which extend inward (vertically) from the rear side of the panel, based on the panel, respectively. Thus, the light irradiated from the rear side of the panel may be prevented from leaking through the gap between the upper end and the lower end of the panel.

Here, although each of the upper blocking portion and the lower blocking portion extends by the appropriate length to block the gap, the brightness of the circumference of the front surface of the panel may be prevented from being darken.

In addition, even in the structure in which the horizontal width of the front surface portion of the mounding member to which the panel is attached is less than the horizontal width of the panel so that the side surface of the mounting member is exposed to the side of the panel assembly, the panel may be prevented from being deteriorated in quality of the outer appearance by the light passing through the side surface portion of the mounting member.

In addition, the side blocking portion may be provided on both the side surfaces of the mounting member, and thus, the light leaking to the side of the mounting member may be blocked by the side blocking portion. Therefore, the circumferential surface of the panel assembly may be prevented from being brighten, and the light may pass through only the front surface of the panel to secure the quality of the outer appearance of the home appliance.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home appliance comprising:

a cabinet defining a storage space; and a door comprising (i) a door body configured to open and close the storage space and (ii) a panel assembly detachably coupled to the door body, wherein the panel assembly comprises:

a panel defining a front surface of the door and through which light is transmitted, a lighting device disposed at a rear side of the panel and configured to irradiate the light through the panel with a set color, an upper bracket supporting the panel from an upper side of the panel, a lower bracket supporting the panel from a lower side of the panel, and a light guide plate that is disposed at a rear side of the panel and that is configured to guide the light irradiated from the lighting device toward the panel, wherein an upper end of the light guide plate is positioned above the upper side of the panel, and a lower end of the light guide plate is positioned below the lower side of the panel, and wherein at least one of the upper bracket or the lower bracket includes a bracket protrusion that protrudes to face and cover an upper end or a lower end of the panel to thereby block the light that passes through the light guide plate from the lighting device.

2. The home appliance according to claim 1, wherein the bracket protrusion covers a rear portion of the panel opposite of the front surface of the door.

3. The home appliance according to claim 1, wherein the bracket protrusion comprises:

a support portion configured to support the upper end or the lower end of the panel, and a blocking portion protruding at a greater distance than the support portion at a rear side of the support portion to cover a portion of a rear surface of the panel.

4. The home appliance according to claim 3, wherein the blocking portion protrudes toward a central portion of the panel via the upper end or the lower end of the panel.

5. The home appliance according to claim 3, wherein each of the upper bracket and the lower bracket includes the bracket protrusion.

6. The home appliance according to claim 3, wherein an upper surface of the panel has a rounded shape and a central portion of the upper surface protrudes at a greatest distance among portions of the upper surface.

7. The home appliance according to claim 6, wherein the support portion is configured to allow the upper end of the panel to contact the upper bracket, and wherein the blocking portion has a rounded shape corresponding to the upper surface of the panel.

8. The home appliance according to claim 7, wherein the blocking portion extends downward from a rear side of the support portion.

9. The home appliance according to claim 8, wherein the blocking portion is disposed between an upper end and a lower end of the upper surface of the panel having the rounded shape.

10. The home appliance according to claim 3, wherein a bottom surface of the panel has a planar shape perpendicular to a front portion of the bottom surface of the panel, and wherein each of a front end and a rear end of the bottom surface of the panel is inclined.

11. The home appliance according to claim 10, wherein the support portion is disposed at the lower bracket and supports the bottom surface of the panel, and wherein the blocking portion protrudes from a rear side of the support portion and supports the inclined rear end of the bottom surface of the panel.

12. The home appliance according to claim 11, wherein an upper surface of the blocking portion is inclined to correspond to the inclined rear end of the bottom surface of the panel and contacts the inclined rear end of the bottom surface of the panel.

13. The home appliance according to claim 11, wherein an upper end of the blocking portion extends between the bottom surface of the panel and an upper end of the inclined rear end of the bottom surface of the panel.

14. The home appliance according to claim 3, wherein the blocking portion is disposed (i) between the upper end of the light guide plate and the upper end of the panel or (ii) between the lower end of the light guide plate and the lower end of the panel.

15. The home appliance according to claim 14, wherein the door further comprises a mounting member provided between the panel and the light guide plate and made of a material through which the light is transmitted, wherein the mounting member comprises:

a front surface portion to which the panel is attached, and a plurality of side surface portions extending rearward from both ends of the front surface portion and defining side surfaces of the panel assembly, and wherein both ends of the light guide plate are mounted on the plurality of side surface portions, respectively.

16. The home appliance according to claim 15, wherein an upper end and a lower end of the front surface portion protrude at a greater distance than an upper end and a lower end of each of the light guide plate and the blocking portion.

17. The home appliance according to claim 16, wherein the plurality of side surface portions are opaque.

18. The home appliance according to claim 16, wherein each of the plurality of side surface portions includes a side blocking portion that is made of a material capable of blocking light and that covers the plurality of side surface portions.

19. The home appliance according to claim 14, wherein each of left and right surfaces of the light guide plate is coupled to a side blocking portion made of a material capable of blocking light and configured to block the light of the light guide plate from being emitted laterally.

20. The home appliance according to claim 3, wherein the lighting device is provided at an inside of the lower bracket, and wherein the lighting device includes a light source disposed below support portion and the blocking portion.

* * * * *